US011749193B2

(12) United States Patent
Liu et al.

(10) Patent No.: US 11,749,193 B2
(45) Date of Patent: Sep. 5, 2023

(54) PIXEL CIRCUIT, METHOD FOR DRIVING A PIXEL CIRCUIT, DISPLAY PANEL, AND DISPLAY APPARATUS

(71) Applicants: Wuhan Tianma Microelectronics Co., Ltd., Wuhan (CN); Wuhan Tianma Microelectronics Co., Ltd. Shanghai Branch, Shanghai (CN)

(72) Inventors: Zhi Liu, Wuhan (CN); Yana Gao, Wuhan (CN); Fei Wu, Wuhan (CN); Yue Li, Wuhan (CN); Xingyao Zhou, Wuhan (CN); Xueqi Tian, Wuhan (CN)

(73) Assignees: Wuhan Tianma Microelectronics Co., Ltd., Wuhan (CN); Wuhan Tianma Microelectronics Co., Ltd. Shanghai Branch, Shanghai (CN)

( * ) Notice: Subject to any disclaimer, the term of this patent is extended or adjusted under 35 U.S.C. 154(b) by 0 days.

(21) Appl. No.: 17/669,648

(22) Filed: Feb. 11, 2022

(65) Prior Publication Data

US 2022/0165214 A1 May 26, 2022

(30) Foreign Application Priority Data

Sep. 14, 2021 (CN) ..... 202111074950.5

(51) Int. Cl.
*G09G 3/3233* (2016.01)

(52) U.S. Cl.
CPC ... *G09G 3/3233* (2013.01); *G09G 2300/0842* (2013.01); *G09G 2310/0286* (2013.01); *G09G 2310/061* (2013.01); *G09G 2320/0214* (2013.01); *G09G 2320/0233* (2013.01)

(58) Field of Classification Search
CPC ..... G09G 3/3233; G09G 2300/0842; G09G 2310/0286; G09G 2310/061; G09G 2320/0214; G09G 2320/0233
See application file for complete search history.

(56) References Cited

U.S. PATENT DOCUMENTS

2021/0166630 A1* 6/2021 Kim ..... G11C 19/28

FOREIGN PATENT DOCUMENTS

| | | | |
|---|---|---|---|
| CN | 102467876 | A | 5/2012 |
| CN | 108682399 | A | 10/2018 |
| CN | 112071268 | A | 12/2020 |
| CN | 113035134 | A | 6/2021 |
| CN | 213601595 | U | 7/2021 |

* cited by examiner

*Primary Examiner* — Kenneth B Lee, Jr.
(74) *Attorney, Agent, or Firm* — KDW Firm PLLC

(57) ABSTRACT

Provided a pixel circuit, a method for driving a pixel circuit, a display panel, and a display apparatus. The pixel circuit applied in a display panel includes a data writing module, a drive transistor, a leakage current alleviation module, a first power supply terminal, and a data signal terminal. The data writing module configured to write data signal of the data signal terminal to gate of the drive transistor in data writing stage; the leakage current alleviation module configured to transmit leakage current generated by the data writing module to first power supply terminal in leakage current alleviation stage; and the drive transistor configured to drive a light-emitting element to emit light in light emission stage. The leakage current alleviation stage located at least between the data writing stage and the light emission stage, enhancing the luminance accuracy of the light-emitting element and the display uniformity of the display panel.

27 Claims, 26 Drawing Sheets

PIXEL CIRCUIT, METHOD FOR DRIVING A PIXEL CIRCUIT, DISPLAY PANEL, AND DISPLAY APPARATUS

CROSS-REFERENCE TO RELATED APPLICATION(S)

This application claims priority to Chinese Patent Application No. 202111074950.5 filed Sep. 14, 2021, titled "PIXEL CIRCUIT, METHOD FOR DRIVING A PIXEL CIRCUIT, DISPLAY PANEL, AND DISPLAY APPARATUS", the disclosure of which is incorporated herein by reference in its entirety.

FIELD

Embodiments of the present disclosure relate to the field of display technologies and, in particular, to a pixel circuit, a method for driving a pixel circuit, a display panel, and a display apparatus.

BACKGROUND

An organic light-emitting diode (OLED) display has become one of the most potential displays currently due to its advantages such as auto-luminescence, low drive voltage, high luminous efficiency, short response time, and flexible display.

Since an OLED element of the OLED display is a current-driven element, a corresponding pixel circuit is required for supplying a drive current to the OLED element and driving the OLED element to emit light. The pixel driving circuit of the OLED display commonly includes elements like transistors and capacitors. The transistors of the pixel circuit may include a drive transistor and a data writing transistor. The data writing transistor writes a data signal of a data signal terminal to a gate of the drive transistor in a data writing stage so that in a light emission stage, the drive transistor can generate a drive current for driving the OLED element based on a gate voltage of the drive transistor.

However, due to the characteristics of a transistor, a relatively small current (leakage current) may pass by when the transistor is turned off. In this case, after the data writing stage ends, the leakage current generated by the data writing transistor may affect the drive current generated by the drive transistor, Thus, affecting the luminance of a light-emitting element in the light emission stage. Moreover, when the interval between the data writing stage and the light emission stage is relatively long, too many charges are accumulated due to the leakage current, which would have a significant effect on the drive current generated by the drive transistor, Thus, affecting the display uniformity of the display panel.

SUMMARY

According to the preceding problems, embodiments of the present disclosure provide a pixel circuit, a method for driving a pixel circuit, a display panel, and a display apparatus to reduce the effect of a leakage current on a drive current generated by a drive transistor and thus, enhance display effect.

In a first aspect, embodiments of the present disclosure provide a pixel circuit applied in a display panel. The pixel circuit includes a data writing module, a drive transistor, a leakage current alleviation module, a first power supply terminal, and a data signal terminal.

The Data writing module is configured to write a data signal of the data signal terminal to a gate of the drive transistor in a data writing stage.

The leakage current alleviation module is configured to transmit a leakage current generated by the data writing module to the first power supply terminal in a leakage current alleviation stage.

The drive transistor is configured to drive a light-emitting element to emit light in a light emission stage.

Among which, the leakage current alleviation stage is located at least between the data writing stage and the light emission stage.

Embodiments of the present disclosure further provide a method for driving a pixel circuit. The method is used for driving a pixel circuit. The pixel circuit includes a data writing module, a drive transistor, a leakage current alleviation module, a first power supply terminal, and a data signal terminal, where the data writing module is configured to write a data signal of the data signal terminal to a gate of the drive transistor in a data writing stage; the leakage current alleviation module is configured to transmit a leakage current generated by the data writing module to the first power supply terminal in a leakage current alleviation stage; and the drive transistor is configured to drive a light-emitting element to emit light in a light emission stage. In which, the leakage current alleviation stage is located at least between the data writing stage and the light emission stage. The method includes the steps below.

In the data writing stage, the data writing module writes the data signal of the data signal terminal to the gate of the drive transistor.

In the leakage current alleviation stage, the leakage current alleviation module transmits the leakage current generated by the data writing module to the first power supply terminal.

In the light emission stage, the drive transistor drives the light-emitting element to emit light.

Among which, the leakage current alleviation stage is located at least between the data writing stage and the light emission stage.

In a third aspect, embodiments of the present disclosure further provide a display panel. The display panel includes multiple pixel circuits, and each pixel circuit includes a data writing module, a drive transistor, a leakage current alleviation module, a first power supply terminal, and a data signal terminal, where the data writing module is configured to write a data signal of the data signal terminal to a gate of the drive transistor in a data writing stage; the leakage current alleviation module is configured to transmit a leakage current generated by the data writing module to the first power supply terminal in a leakage current alleviation stage; and the drive transistor is configured to drive a light-emitting element to emit light in a light emission stage. In which, the leakage current alleviation stage is located at least between the data writing stage and the light emission stage.

In a fourth aspect, embodiments of the present disclosure further provide a display apparatus. The display apparatus includes the preceding display panel.

In the pixel circuit, the method for driving a pixel circuit, the display panel, and the display apparatus that are provided in embodiments of the present disclosure, the arrangement in which the leakage current alleviation module is disposed in the pixel circuit enables the leakage current generated by the data writing module to be transmitted to the first power supply terminal in the leakage current alleviation stage between the data writing stage and the light emission stage, preventing the leakage current generated by the data writing module from affecting the luminance when the drive transistor drives the light-emitting element to emit light. Thus, the light-emitting element can emit light accurately. In such a way, when the pixel circuit is applied in a display panel, the display uniformity of the display panel is enhanced, and thus, the display effect of the display panel is improved. Moreover, the leakage current alleviation module configured in the pixel circuit may prevent the leakage current leaked to the light-emitting element in a non-light-emission stage from causing the light-emitting element to emit weak light, that is, causing the phenomenon of the pixel to be turned on abnormally.

DETAILED DESCRIPTION

Figure 1:
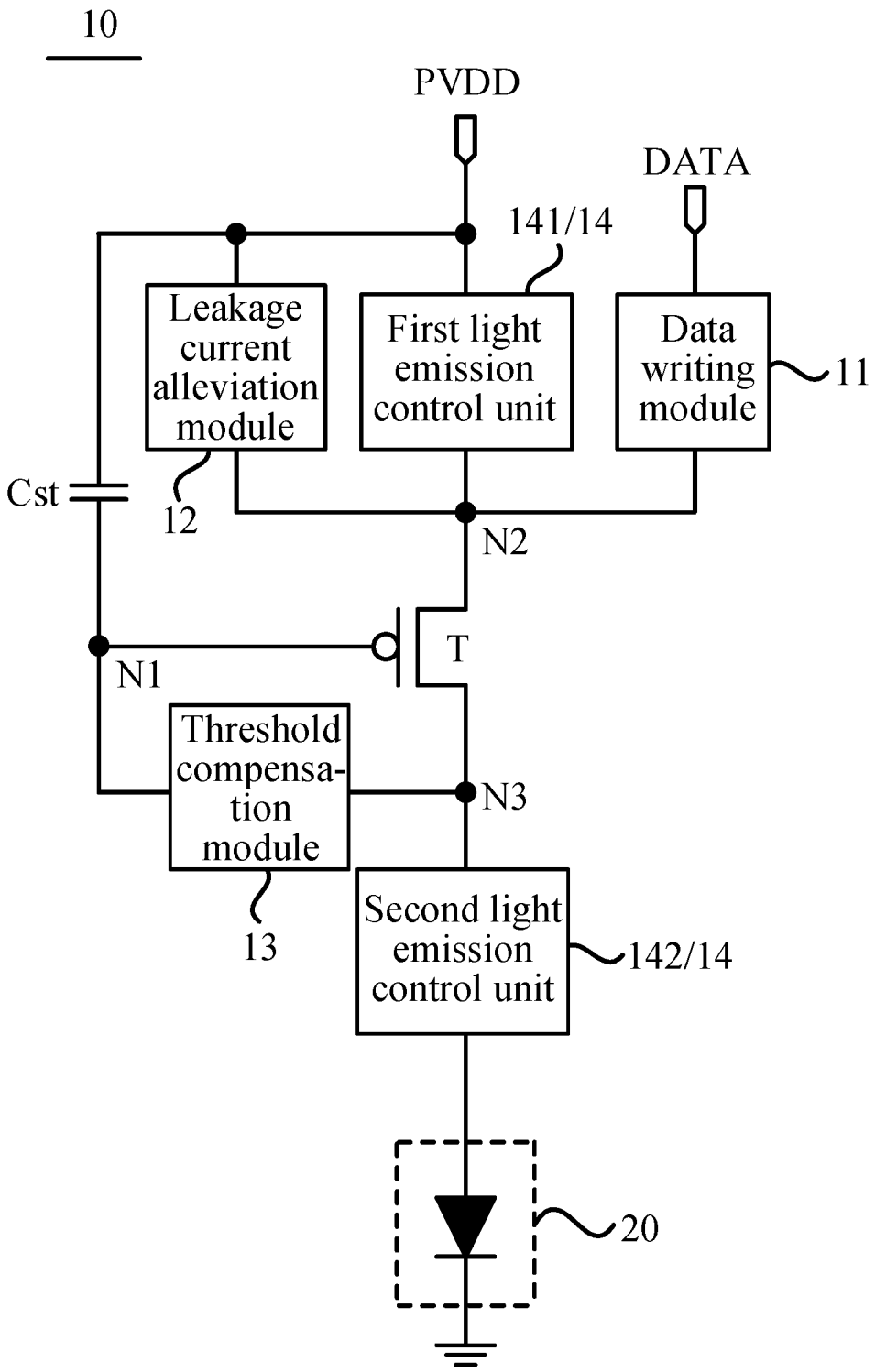
FIG. 1 is a schematic diagram of a pixel circuit according to embodiments of the present disclosure.

The present disclosure is further described hereinafter in detail in conjunction with drawings and embodiments. It is to be understood that embodiments described hereinafter are intended to explain the present disclosure and not to limit the present disclosure. Additionally, it is to be noted that for ease of description, only part, not all, of structures related to the present disclosure are illustrated in the drawings.

It is obvious for those skilled in the art that various modifications and changes in the present disclosure may be made without departing from the spirit or scope of the present disclosure. Accordingly, the present disclosure is intended to cover modifications and variations of the present disclosure that fall within the scope of the corresponding claims (the claimed technical solutions) and their equivalents. It is to be noted that embodiments of the present disclosure, if not in collision, may be combined with each other.

In the related art, in a display panel, at least part of the pixel circuits in the same column share a data signal line. The data signal line may transmit a data signal corresponding to each pixel circuit at different times and writes a data signal to each pixel circuit at different times so that each pixel circuit can drive a corresponding light-emitting element to emit light at a corresponding luminance level based on a received data signal. A pixel circuit generally includes a data signal terminal, a data writing module configured to control whether a data signal of the data signal terminal is written, and a drive transistor configured to drive a light-emitting element to emit light based on a written data signal. The data signal line is electrically connected to the data signal terminal of each pixel circuit so that a data signal transmitted by the data signal line is transmitted to a corresponding pixel circuit, and the writing data signals at different times is implemented by controlling that the data writing module in each pixel circuit is turned on at different times.

However, after controlling a corresponding data signal to be written, the data writing module of a pixel circuit, even in the OFF state, generates a corresponding leakage current when the data signal terminal of the pixel circuit receives a data signal of another pixel circuit. The leakage current may affect the data signal written to the pixel circuit. As a result, when the drive transistor in the pixel circuit drives a light-emitting element to emit light based on the data signal, the accuracy of the light-emitting element is affected. Especially in the case where the display panel displays an image as "a black pattern in a white background", due to the effect of the leakage current of the data writing module, a dark region in a similar shape to the black pattern may occur in a position of the white background, Thus, affecting the display effect of the display panel. Moreover, when the interval between a data writing stage of the pixel circuit and a light emission stage of the pixel circuit is relatively long, the current leakage of the data writing module has a relatively significant effect on the written data signal and thus, has a more obvious effect on the luminance of the light-emitting element in the light emission stage, thereby affecting the display uniformity of the display panel. Moreover, a leakage current alleviation module configured in the pixel circuit may prevent the leakage current leaked to the light-emitting element in a non-light-emission stage from causing the light-emitting element to emit weak light, that is, causing the phenomenon of the pixel to be turned on abnormally.

To solve the preceding problems, embodiments of the present disclosure provide a pixel circuit applicable to a display panel. The pixel circuit may include a data writing module, a drive transistor, a leakage current alleviation module, a first power supply terminal, and a data signal terminal; the data writing module may be configured to write a data signal of the data signal terminal to the gate of the drive transistor in a data writing stage; the leakage current alleviation module may be configured to transmit a leakage current generated by the data writing module to the first power supply terminal in a leakage current alleviation stage; and the drive transistor is configured to drive a light-emitting element to emit light in a light emission stage. Among which, the leakage current alleviation stage is located at least between the data writing stage and the light emission stage.

With the adoption of the preceding technical solutions, the leakage current alleviation module is disposed in the pixel circuit so as to transmit a leakage current generated by the data writing module to the first power supply at least in the leakage current alleviation stage between the data writing stage and the light emission stage, preventing the leakage current generated by the data writing module from affecting the luminance when the drive transistor drives the light-emitting element to emit light. Thus, the light-emitting element can emit light accurately. In such a way, when the pixel circuit is applied in a display panel, the display uniformity of the display panel is enhanced, and thus, the display effect of the display panel is improved.

Based on the embodiments of the present disclosure, all other embodiments obtained by those of ordinary skill in the art without creative work are within the scope of the present disclosure. Technical solutions in embodiments of the present disclosure are described clearly and completely hereinafter in conjunction with the drawings of the embodiments of the present disclosure.

FIG. 1 is a schematic diagram of a pixel circuit according to embodiments of the present disclosure. As shown in FIG. 1, a pixel circuit 10 includes a data writing module 11, a drive transistor T, and a data signal terminal DATA; in a data writing stage, the data writing module 11 can write a data signal Vdata of the data signal terminal DATA to a gate of the drive transistor T; and in a light emission stage, the drive transistor T can generate a corresponding drive current based on the data signal written to the gate of the drive transistor T in the data writing stage and supply the drive current to a light-emitting element 20 to drive the light-emitting element 20 to emit light.

Generally, in a certain luminance range, the luminance of a light-emitting element varies with a drive current supplied by the drive transistor T, and the magnitude of the drive current is related to a gate voltage of the drive transistor T. That is, the drive current generated by the drive transistor T may be expressed as below.

$$Id=k\times(Vgs-Vth)^2$$

Among which, k denotes a coefficient related to a structure of the drive transistor T and a material of the drive transistor T; Vth denotes a threshold voltage of the drive transistor T; and Vgs denotes a voltage difference between a gate voltage of the drive transistor T and a source voltage of the drive transistor T. That is, when the source voltage of the drive transistor keeps constant, the drive current generated by the drive transistor T varies with the gate voltage of the drive transistor T.

It is to be understood that in the case where the source voltage of the drive transistor T is constant, when the drive transistor T is a P-type transistor, a lower gate potential of the drive transistor T indicates a greater drive current generated by the drive transistor T; and when the drive transistor T is an N-type transistor, a higher gate potential of the drive transistor T indicates a greater drive current generated by the drive transistor T. Accordingly, when the light-emitting element 20 needs to display different luminance at different times, different data signals may be written to the gate of the drive transistor T in different data writing stages. For ease of description, an example in which the drive transistor is a P-type transistor is taken for exemplarily describing technical solutions in embodiments of the present disclosure.

Moreover, the pixel circuit 10 includes a leakage current alleviation module 12 and a first power supply terminal PVDD. In the leakage current alleviation stage at least between the data writing stage and the light emission stage, the leakage current alleviation module 12 can transmit a leakage current generated by the data writing module 11 to the first power supply terminal PVDD, preventing the leakage current generated by the data writing module 11 from affecting the luminance when the drive transistor T drives the light-emitting element 20 to emit light. Thus, the light-emitting element 20 can emit light accurately. In such a way, when the pixel circuit is applied in a display panel, the display uniformity of the display panel is enhanced, and thus, the display effect of the display panel is improved. Moreover, the leakage current alleviation module 12 configured in the pixel circuit 10 may prevent a phenomenon that the leakage current is leaked to the light-emitting element 20 in a non-light-emission stage, causing the light-emitting element 20 to emit weak light, that is, may prevent a phenomenon of the pixel to be turned on abnormally.

Among which, t and t' denote the duration of the leakage current alleviation stage and the duration of the data writing stage respectively, which satisfies $t \geq n \times t'$, and $n \geq 10$. In such a way, when the leakage current alleviation stage is located between the data writing stage and the light emission stage, the interval between the data writing stage and the light emission stage of the same pixel circuit 10 is relatively long. That is, after performing the data writing into multiple rows of pixel circuits 10, the display panel controls pixel circuits 10 in the first row to enter their light emission stages and drive light-emitting elements to emit light so that dimming driving is performed and the display effect of the display panel is improved.

It is to be noted that in the pixel circuit provided in embodiments of the present disclosure, the connection between the leakage current alleviation module and the data writing module may be configured based on actual needs. Moreover, under the premise that the leakage current alleviation module can transmit the leakage current generated by the data writing module to the first power supply terminal, the specific connection between the leakage current alleviation module and the data writing module is not limited in embodiments of the present disclosure. Technical solutions in embodiments of the present disclosure are described hereinafter in conjunction with examples.

In some embodiments, with continued reference to FIG. 1, a first terminal of the leakage current alleviation module 12 is electrically connected to the first power supply terminal PVDD; a second terminal of the leakage current alleviation module 12 is electrically connected to a second terminal of the data writing module 11; and a first terminal of the data writing module 11 is electrically connected to the data signal terminal DATA. With this arrangement, the leakage current alleviation module 12 is directly electrically connected to the data writing module 11 and can directly transmit the leakage current generated by the data writing module 11 to the first power supply terminal PVDD so as to prevent the leakage current generated by the data writing module 11 from affecting a potential written to the gate of the drive transistor T in the data writing stage.

Figure 2:
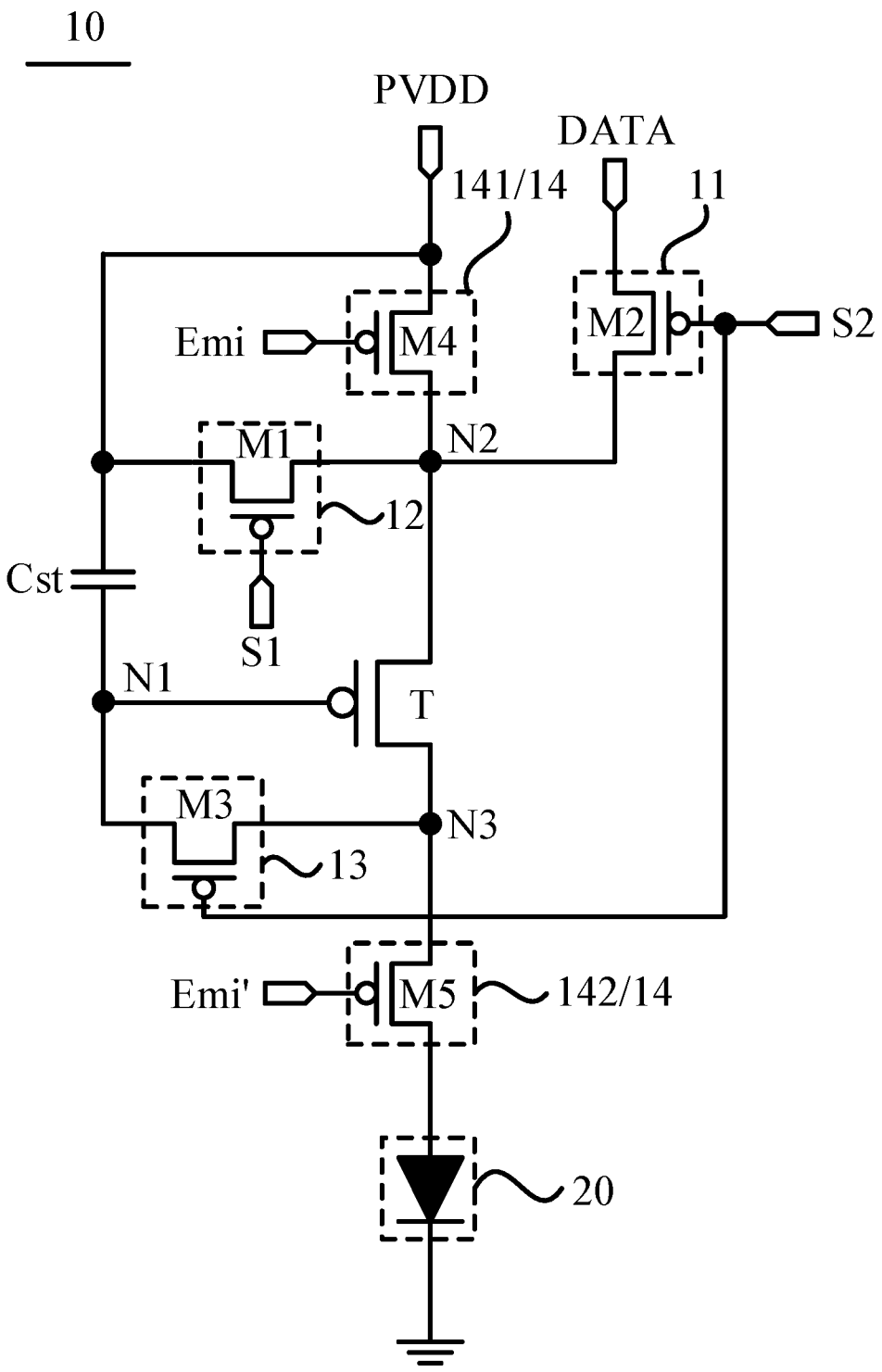
FIG. 2 is a schematic circuit diagram of a pixel circuit according to embodiments of the present disclosure.

In some embodiments, FIG. 2 is a schematic circuit diagram of a pixel circuit according to embodiments of the present disclosure. As shown in FIG. 2, the leakage current alleviation module 12 may include a first transistor M1. In such a way, the pixel circuit 10 further includes a first control terminal S1; a gate of the first transistor M1 is electrically connected to the first control terminal S1; a first pole of the first transistor M1 is electrically connected to the first power supply terminal PVDD; and a second pole of the first transistor M1 is electrically connected to the second terminal of the data writing module 11. With this arrangement, the first transistor M1 can be turned on or off under the control of a first control signal of the first control terminal S1. When the first transistor M1 is turned on, the first transistor M1 can transmit the leakage current generated by the data writing module 11 to the first power supply terminal PVDD to prevent the leakage current generated by the data writing module 11 from affecting the luminance of the light-emitting element 20.

Among which, the data writing module 11 may include a data writing transistor M2. In this case, the pixel circuit 10 may further include a second control terminal S2; a gate of the data writing transistor M2 is electrically connected to the second control terminal; a first pole of the data writing transistor M2 is electrically connected to the data signal terminal DATA; and a second pole of the data writing transistor M2 is electrically connected to the second pole of the first transistor M1. With this arrangement, the data writing transistor M2 can be turned on or off under the control of a second control signal of the second control terminal S2. When the data writing transistor M2 is turned on, the data writing transistor M2 enables the data signal Vdata of the data signal terminal DATA to be written to the gate of the drive transistor T. When the data writing transistor M2 is turned off, the data writing transistor M2 generates a certain leakage current due to the characteristics of the data writing transistor M2 itself. The leakage current can be transmitted to the first power supply terminal PVDD through the turned-on first transistor M1. The first power supply terminal PVDD has a fixed power supply signal Vdd, and the leakage current generated by the data writing transistor M2 is relatively small. Accordingly, even if the first transistor M1 transmits the leakage current generated by the data writing transistor M2 to the first power supply terminal PVDD, the power supply signal Vdd of the first power supply terminal PVDD is not affected.

In some embodiments, with continued reference to FIG. 1, the pixel circuit 10 further includes a light emission control module 14; and the light emission control module 14 is configured to, in the light emission stage, control the drive current generated by the drive transistor T to be supplied to the light-emitting element 20 to drive the light-emitting element 20 to emit light.

Among which, the light emission control module 14 may include a first light emission control unit 141 and a second light emission control unit 142; the first light emission control unit 141 is configured to control the connection or disconnection between a first pole of the drive transistor T and the first power supply terminal PVDD; and the second light emission control unit 142 is configured to control the connection or disconnection between a second pole of the drive transistor T and the light-emitting element 20. With this arrangement, when the first light emission control unit 141 and the second light emission control unit 142 are turned on simultaneously, a current path is formed between the first power supply terminal PVDD and the light-emitting element 20, so that the drive current generated by the drive transistor T is supplied to the light-emitting element 20 to drive the light-emitting element 20 to emit light.

In some embodiments, with continued reference to FIG. 2, the light emission control module 14 may further include a first light emission control transistor M4 and a second light emission control transistor M5. In such a way, the pixel circuit 10 may further include a first light emission control terminal Emi and a second light emission control terminal Emi'; a gate M42 of the first light emission control transistor M4 is electrically connected to the first light emission control terminal Emi; a gate M52 of the second light emission control transistor M5 is electrically connected to the second light emission control terminal Emi'; a first pole of the first light emission control transistor M4 is electrically connected to the first power supply terminal PVDD; a second pole of the first light emission control transistor M4 is electrically connected to the first pole of the drive transistor T; a first pole of the second light emission control transistor M5 is electrically connected to the second pole of the drive transistor T; and a second pole of the second light emission control transistor M5 is electrically connected to the light-emitting element 20. With this arrangement, the first light emission control transistor M4 may be turned on or off under the control of a light emission control signal of the first light emission control terminal Emi, and the second light emission control transistor M5 may be turned on or off under the control of a light emission control signal of the second light emission control terminal Emi'. Among which, in the light emission stage, the first light emission control transistor M4 and the second light emission control transistor M5 are turned on simultaneously. Accordingly, a current path is formed between the first power supply terminal PVDD and the light-emitting element 20 so that the drive current generated by the drive transistor T is supplied to the light-emitting element 20 to drive the light-emitting element 20 to emit light.

In some embodiments, with continued reference to FIG. 1, the pixel circuit 10 may further include a threshold compensation module 13; a first terminal of the threshold compensation module 13 is electrically connected to the second pole of the drive transistor T; and a second terminal of the threshold compensation module 13 is electrically connected to the gate of the drive transistor T. In such a way, the first terminal of the data writing module 11 is electrically connected to the data signal terminal DATA, and the second terminal of the data writing module 11 is electrically connected to the first pole of the drive transistor T. The threshold compensation module 13 is configured to compensate a threshold voltage Vth of the drive transistor T to the gate of the drive transistor T in the data writing stage.

In some embodiments, in the data writing stage, the data writing module 11, the drive transistor T, and the threshold compensation module 13 may be controlled to stay in the ON state simultaneously so that the data signal Vdata of the data signal terminal DATA is transmitted to the gate of the drive transistor T sequentially through the turned-on Data writing module 11, the turned-on drive transistor T, and the turned-on threshold compensation module 13, causing the gate voltage of the drive transistor T to change continually. When the voltage difference between the gate voltage of the drive transistor T and the voltage of the first pole of the drive transistor T is equal to the threshold voltage Vth of the drive transistor T, the drive transistor T is in the critical stage of turning off. In this case, the voltage difference Vgs between the voltage VN1 of the gate (that is, a first node N1) of the drive transistor T and the voltage VN2 of the first pole (that is, a second node N2) of the drive transistor T is expressed as below.

$$Vgs=Vth=VN1-VN2$$

The voltage VN2 of the first pole of the drive transistor T is the data signal Vdata transmitted by the data writing module 11; accordingly, the gate voltage of the drive transistor T satisfies that VN1=Vdata+Vth. That is, the gate voltage of the drive transistor T is a sum of the data signal Vdata written by the data writing module 11 and the threshold voltage Vth compensated by the threshold compensation module 13. With this arrangement, the drive current Id generated by the drive transistor T based on the gate voltage of the drive transistor T is expressed as below.

$$Id=k*(Vdata+Vth-VN2-Vth)^2=k*(Vdata-VN2)^2$$

That is, the drive current Id generated by the drive transistor T is irrelevant to the threshold voltage Vth of the drive transistor T so that processes and element aging are prevented from causing the threshold voltage Vth of the drive transistor T to drift and the drive current generated by the drive transistor T is prevented from being affected. Accordingly, the accuracy of the drive current generated by the drive transistor T is improved, and thus, the luminance accuracy of the light-emitting element 20 is enhanced. In such a way, when the pixel circuit 10 is applied in a display panel, the display uniformity of the display panel is enhanced.

In some embodiments, with continued reference to FIG. 2, the threshold compensation module 13 may include a threshold compensation transistor M3. In this case, the second control terminal S2 of the pixel circuit 10 is further electrically connected to a gate of the threshold compensation transistor M3; a first pole of the threshold compensation transistor M3 is electrically connected to the second pole of the drive transistor T; and a second pole of the threshold compensation transistor M3 is electrically connected to the gate of the drive transistor T. With this arrangement, the threshold compensation transistor M3 can be turned on or off under the control of the second control signal of the second control terminal S2. Moreover, when being turned on, the threshold compensation transistor M3 enables the data signal Vdata to be written to the gate of the drive transistor T and compensates the threshold voltage of the drive transistor T to the gate of the drive transistor T.

Additionally, after the data writing stage of the pixel circuit 10 is ended, the data signal written to the gate of the drive transistor T needs to be held until an end of a display image frame of the display panel. Accordingly, the pixel circuit further includes a storage capacitor Cst. The first plate of the storage capacitor Cst is electrically connected to the gate of the drive transistor T, and the second plate of the storage capacitor Cst is electrically connected to the first power supply terminal PVDD. The storage capacitor Cst can store the gate voltage of the drive transistor T so that the gate voltage of the drive transistor T can keep stable until the end of the display image frame.

It is to be noted that each transistor in the pixel circuit 10 may be an N-type transistor or a P-type transistor. When a transistor is an N-type transistor, the transistor is turned on under the control of a high-level control signal and is turned off under the control of a low-level control signal. When a transistor is a P-type transistor, the transistor is turned on under the control of a low-level control signal and is turned off under the control of a high-level control signal.

It is to be understood that each transistor mentioned in embodiments of the present disclosure may be a single-gate structure (including one gate) or a double-gate structure (including two gates). When a transistor is a double-gate structure, the two gates may connect to a same control terminal or different control terminals. The preceding electrical connection between a control terminal and a gate of a transistor may be considered as the electrical connection with one gate of the transistor, and the connection with the other gate is not specifically limited in embodiments of the present disclosure.

Figure 3:
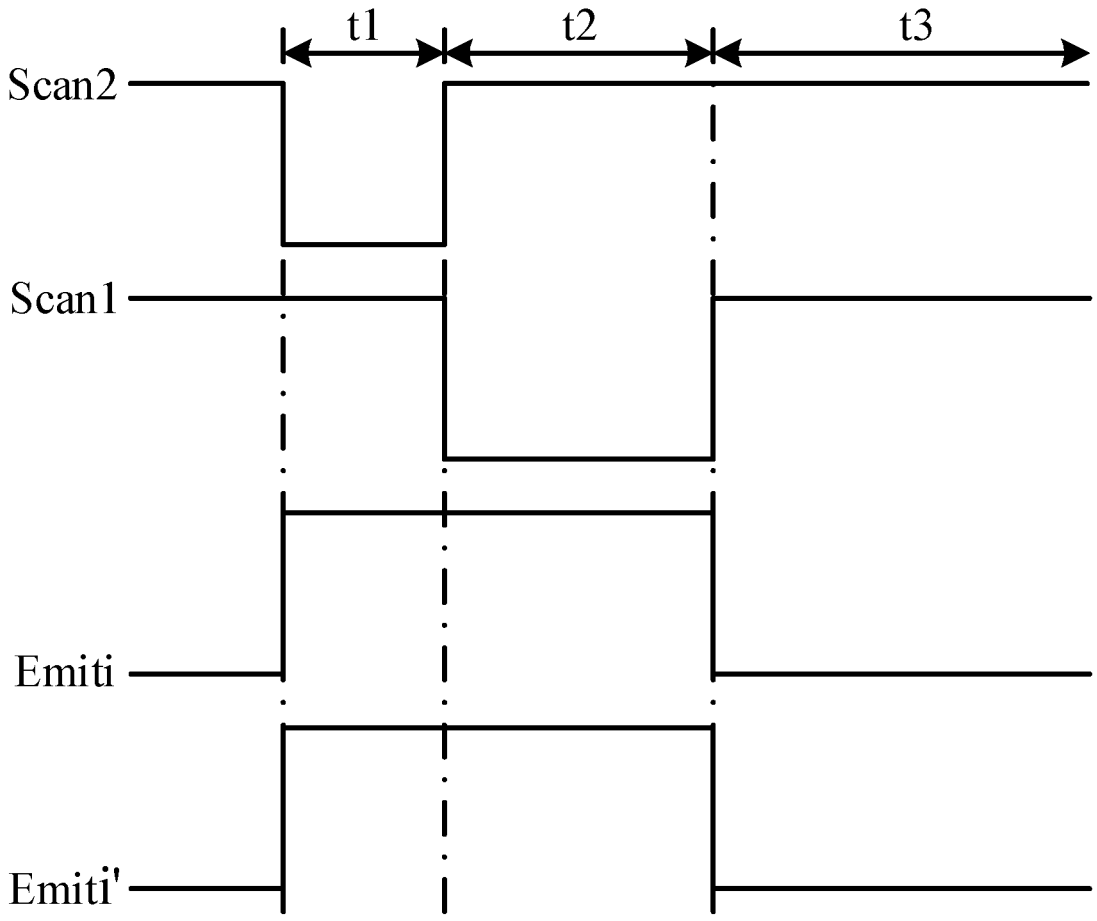
FIG. 3 is a driving timing diagram of the pixel circuit corresponding to FIG. 2.

As an example, each transistor in the pixel circuit being a P-type transistor is taken for illustration. FIG. 3 is a drive timing diagram of the pixel circuit corresponding to FIG. 2. With combined reference to FIGS. 2 and 3, the driving process of the pixel circuit is as below.

In the data writing stage t1, the first control signal Scan1 of the first control terminal S1 is a high-level signal; the first transistor M1 is in the OFF state; the first light emission control signal Emiti of the first light emission control terminal Emi is a high-level signal; the first light emission control transistor M4 is in the OFF state; the second light emission control signal Emiti' of the second light emission control terminal Emi' is a high-level signal; the second light emission control transistor M5 is in the OFF state; the second control signal Scan2 of the second control terminal S2 is a low-level signal; and the data writing transistor M2 and the threshold compensation transistor M3 are both in the ON state. In such a way, the data signal Vdata of the data signal terminal DATA is transmitted to the gate of the drive transistor T sequentially through the turned-on data writing transistor M2, the turned-on drive transistor T, and the turned-on threshold compensation transistor M3 and is stored in the storage capacitor Cst. Until the gate voltage of the drive transistor T reaches a sum of the data signal Vdata and the threshold voltage Vth of the drive transistor T, the gate voltage of the drive transistor T keeps constant.

In the leakage current alleviation stage t2, the first control signal Scan1 turns to a low-level signal; the second control signal Scan2 turns to a high-level signal; and the first light emission control signal Emiti and the second light emission control signal Emiti' are held as high-level signals. In this case, the first transistor M1 is in the ON state, and the data writing transistor M2, the threshold compensation transistor M3, the first light emission control transistor M4, and the second light emission control transistor M5 are all in the OFF state; accordingly, the first transistor M1 is in the low-resistance state, and the threshold compensation transistor M3, the first light emission control transistor M4, and the second light emission control transistor M5 are all in the high-resistance state. The leakage current generated by the data writing transistor M2 due to the characteristics of the data writing transistor M2 can be transmitted to the first power supply terminal PVDD through the first transistor M1 in the low-resistance state, but would not be transmitted to the drive transistor T through the threshold compensation transistor M3 in the high-resistance state or would not be transmitted to the light-emitting element 20 through the second light emission control transistor M5 in the high-resistance state.

In the light emission stage t3, the first control signal Scan1 turns to a high-level signal; the second control signal Scan2 is held as a high-level signal; and the first light emission control signal Emiti and the second light emission control signal Emiti' turn to low-level signals. In this case, the first light emission control transistor M4 and the second light emission control transistor M5 are both in the ON state, and the first transistor M1, the data writing transistor M2, and the threshold compensation transistor M3 are all in the OFF state. The power supply signal Vdd of the first power supply terminal PVDD is transmitted to the first pole of the drive transistor T through the turned on first light emission control transistor M4 so that the first pole of the drive transistor T has a fixed high-level power supply signal, the drive transistor T is in the ON state again, a current path is formed between the first power supply terminal PVDD and the light-emitting element 20, and the drive transistor T generates the drive current Id expressed as below.

$$Id=k*(Vdata+Vth-Vdd-Vth)^2=k*(Vdata-Vdd)^2$$

With this arrangement, in the light emission stage t3, the drive current generated by the drive transistor T only varies with the data signal Vdata so as to drive the light-emitting element 20 to emit light stably.

It is to be noted that the preceding driving process of the pixel circuit 10 is only an exemplary driving process in embodiments of the present disclosure. In the preceding driving process, the leakage current alleviation stage t2 and the light emission stage t3 do not overlap each other. However, in embodiments of the present disclosure, the leakage current alleviation stage t2 may overlap the light emission stage t3. In such a way, in the time segment in which the leakage current alleviation stage t2 overlaps the light emission stage t3, the first transistor M1, the first light emission control transistor M4, and the second light emission control transistor M5 are turned on simultaneously so that the power supply signal of the first power supply signal terminal PVDD may be transmitted to the first pole of the drive transistor T sequentially through the first transistor M1 and the first light emission control transistor M4.

It is to be understood that when a transistor in the pixel circuit is a P-type transistor, a low-level signal needs to be supplied to the gate of the P-type transistor to control the P-type transistor to be turned on, and a high-level signal needs to be supplied to the gate of the P-type transistor to control the P-type transistor to be turned off. In such a way, when the P-type transistor turns from the ON state to the OFF state, the voltage supplied to the gate of the P-type transistor needs to turn from a low level to a high level.

With continued reference to FIGS. 2 and 3, the threshold compensation transistor M3 is taken for example. When the data writing stage t1 ends, the second control signal Scan2 received by the gate of the threshold compensation transistor M3 turns from a low-level signal to a high-level signal. Since the gate of the threshold compensation transistor M3 overlaps an active layer of the threshold compensation transistor M3, a coupling capacitance is formed between the gate of the threshold compensation transistor M3 and the active layer of the threshold compensation transistor M3. When the gate voltage of the threshold compensation transistor M3 jumps, the voltage of the active layer of the threshold compensation transistor M3 also jumps. Moreover, a second electrode region of the active layer of the threshold compensation transistor M3 serves as the second pole of the threshold compensation transistor M3 to be directly electrically connected to the gate of the drive transistor T; accordingly, when the voltage of the active layer of the threshold compensation transistor M3 rises, the gate voltage of the drive transistor T also rises. Moreover, the variation range of the gate voltage of the drive transistor T is related to a threshold voltage of the threshold compensation transistor M3; that is, a more negative threshold voltage of the threshold compensation transistor M3 indicates a larger range for the variation of the gate voltage of the drive transistor T caused by the jump of the gate voltage of the threshold compensation transistor M3. With this arrangement, the threshold voltage Vth' of the threshold compensation transistor M3 is set to a positive-biased value. For example, the threshold voltage Vth' of the threshold compensation transistor M3 may be set from a negative value to a positive-biased value near 0 V. As an example, the range of the threshold voltage value Vth' of the threshold compensation transistor satisfies $-0.2V \leq Vth' \leq 0.2V$.

It is to be noted that in embodiments of the present disclosure, the setting of a positive-biased threshold voltage is not only limited to the threshold compensation transistor but is also applicable to other switch transistors (for example, the data writing transistor) in the pixel circuit.

Additionally, the example in which a transistor is a P-type transistor is taken in the preceding description. When a transistor in the pixel circuit is an N-type transistor, a threshold voltage of the N-type transistor may be set to a negative-biased value. For example, the threshold voltage of the N-type transistor may be set to a negative-biased value near 0 V. The range of the threshold voltage value Vth' also satisfies $-0.2V \leq Vth' \leq 0.2V$. The technical principle of an N-type transistor is similar to the technical principle of a P-type transistor and is not repeated herein.

It is to be understood that the transistors in the pixel circuit may have the same channel type; for example, the transistors are all P-type transistors or all N-type transistors. In other embodiments, the transistors in the pixel circuit may have different channel types. This is not specifically limited in embodiments of the present disclosure. Among which, when the turned-on periods of two transistors with different channel types in the pixel circuit are complementary to each other, the two transistors may share a control terminal. In other embodiments, when the turned-on periods of two transistors with the same channel type in the pixel circuit are the same, the two transistors may also share a control terminal.

Figure 4:
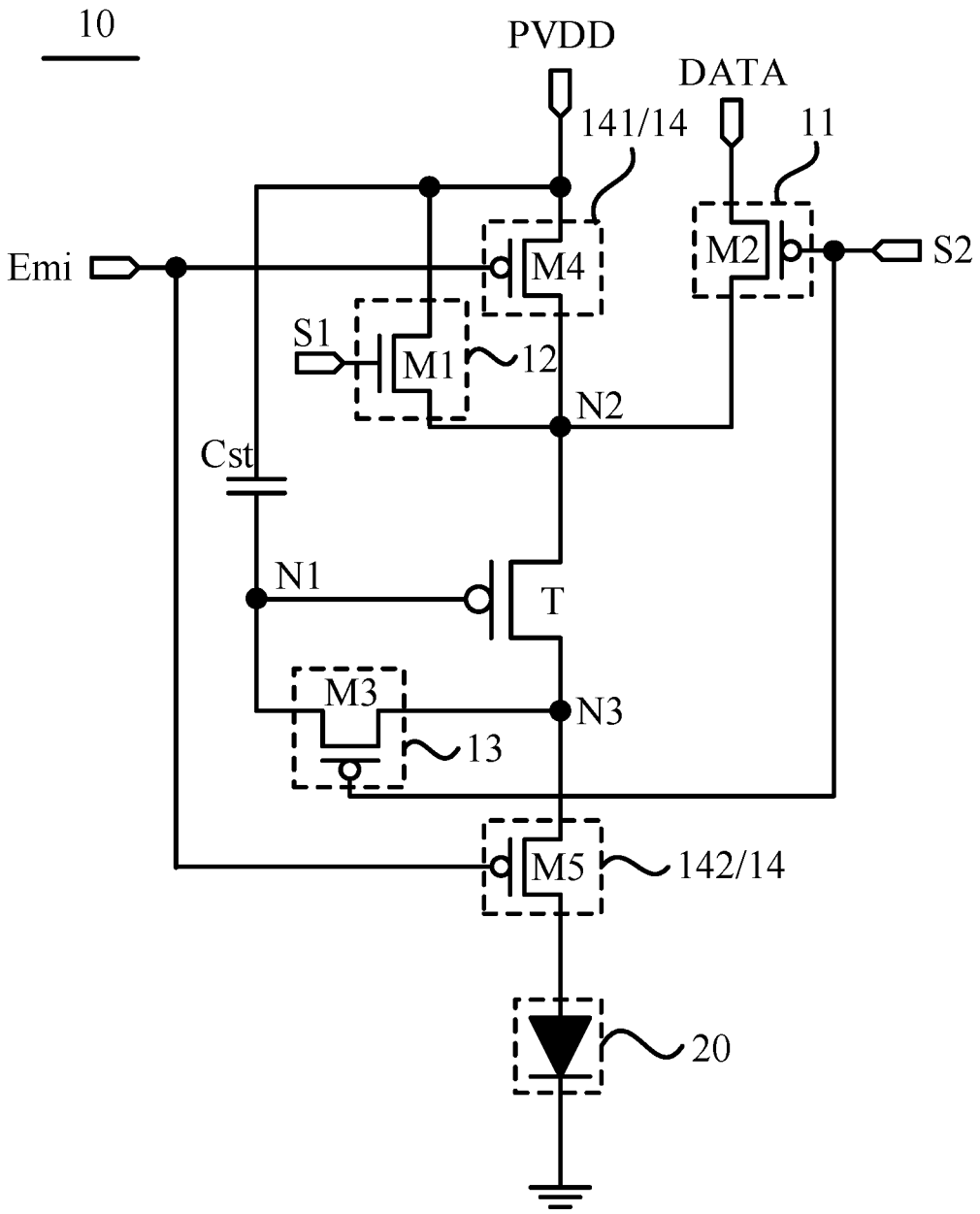
FIG. 4 is another schematic circuit diagram of a pixel circuit according to embodiments of the present disclosure.

In some embodiments, FIG. 4 is another schematic circuit diagram of a pixel circuit according to embodiments of the present disclosure. For the similarities between FIG. 4 and FIG. 2, refer to the preceding description of FIG. 2, which is not repeated herein. Only the differences between FIG. 4 and FIG. 2 are described here as an example. As shown in FIG. 4, the channel type of the first light emission control transistor M4 and the channel type of the second light emission control transistor M5 are the same, and the first light emission control transistor M4 and the second light emission control transistor M5 are turned on in the light emission stage. In this case, the first light emission control transistor M4 and the second light emission control transistor M5 may share a control terminal; that is, the first light emission control terminal Emi also serves as the second light emission control terminal Emi'. With this arrangement, the number of control terminals disposed in the pixel circuit 10 can be decreased, and thus, the structure of the pixel circuit 10 is simplified. Moreover, the number of control signals supplied to the pixel circuit 10 is decreased, simplifying the structure of the scan driving circuit for supplying control signals to the pixel circuit 10 in the display panel, reducing the cost of the display panel, and increasing the screen-to-body ratio of the display panel.

Correspondingly, when the channel type of the first transistor M1 is different from the channel type of the first light emission control transistor M4 and the leakage current alleviation stage may overlap the light emission stage, the first light emission control terminal Emi is configured to receive a light emission control signal Emiti output from an i-th shift register unit, and the first control terminal S1 is configured to receive a light emission control signal output from an (i+1)-th shift register unit. Among which, enable levels for light emission control signals output from each of shift register units are shifted sequentially, and i is a positive integer.

Figure 5:
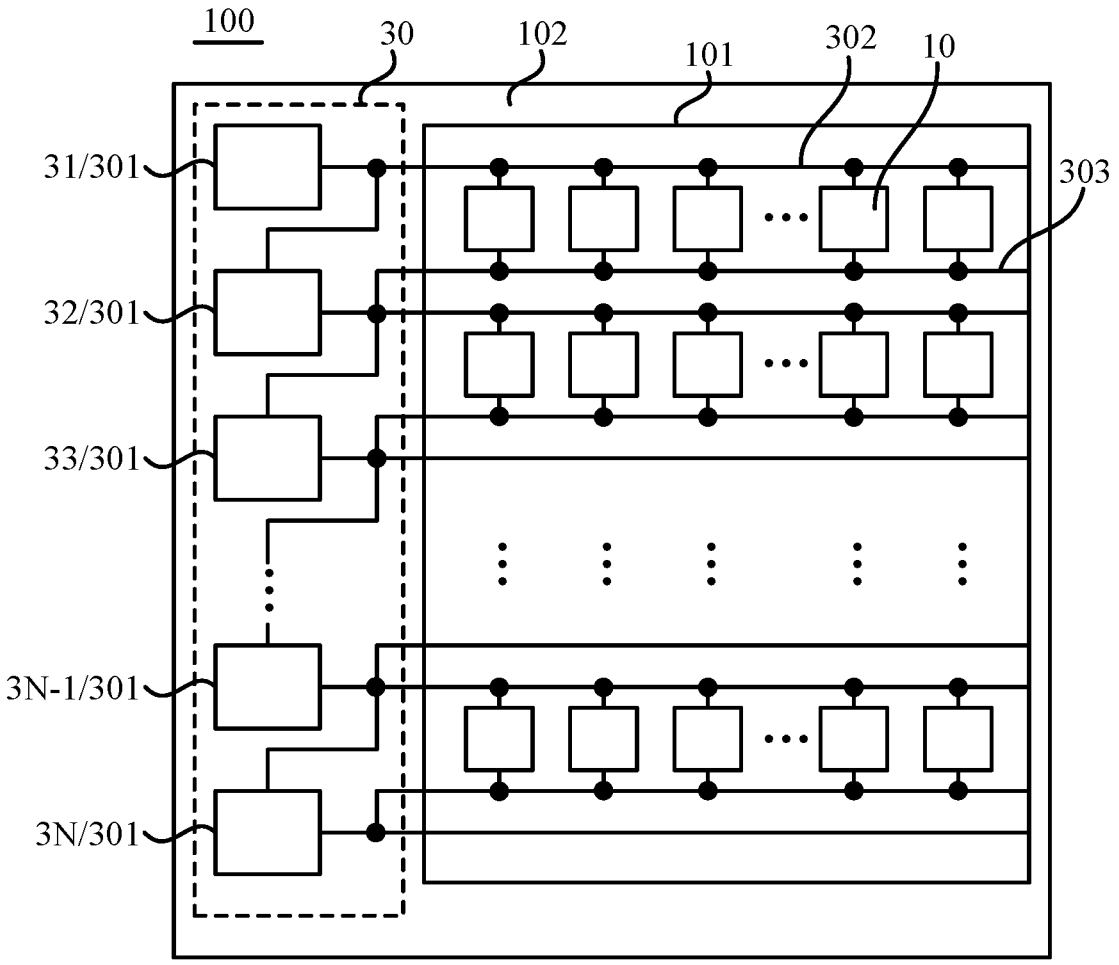
FIG. 5 is a schematic diagram of a display panel according to embodiments of the present disclosure.

In some embodiments, FIG. 5 is a schematic diagram of a display panel according to embodiments of the present disclosure. As shown in FIG. 5, the display panel 100 includes a display region 101 and a non-display region 102 surrounding the display region 101; the non-display region 102 includes a light emission control driving circuit 30; and the light emission control driving circuit 30 includes shift register units 301 disposed in cascade. That is, a signal output terminal of a first shift register unit 31 is electrically connected to a signal input terminal of a second shift register unit 32; a signal output terminal of a second shift register unit 32 is electrically connected to a signal input terminal of a third shift register unit 33, . . . , a signal output terminal of an (N−1)-th shift register unit 3N−1 is electrically connected to a signal input terminal of an N-th shift register unit 3N. With this arrangement, an output signal of a previous shift register unit can control a next shift register unit so that in displaying one display image frame, enable levels for light emission control signals (Emit1, Emit2, Emit3, . . . , Emit (N−1), EmitN) output from each of the shift register units (31, 32, 33, . . . , 3N−1, 3N) are shifted sequentially.

It is to be understood that a driving circuit (not shown in the figure) for supplying another control signal (for example, the second control signal Scan2) needs to be disposed in the non-display region 102 of the display panel 100. This is not specifically limited in embodiments of the present disclosure.

Figure 6:
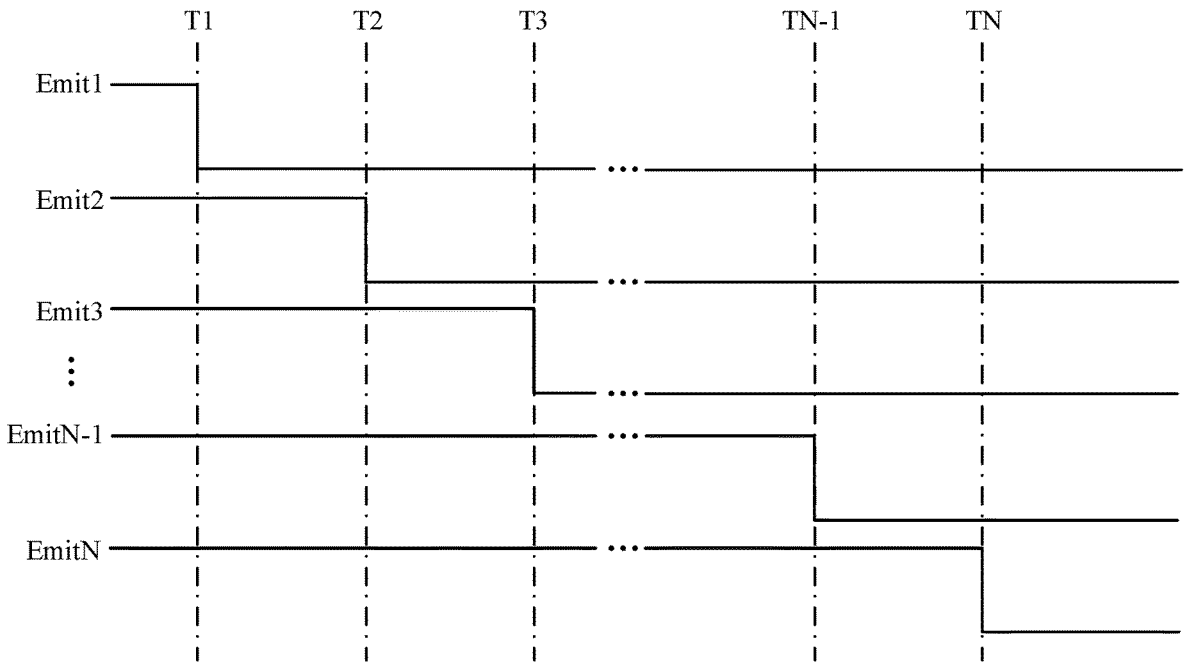
FIG. 6 is a driving timing diagram of a light emission control driving circuit in a display panel according to embodiments of the present disclosure.

As an example, FIG. 6 is a driving timing diagram of a light emission control driving circuit in a display panel according to embodiments of the present disclosure. With combined reference to FIGS. 5 and 6, at a time time moment T1, the light emission control signal Emit1 output from the first shift register unit 31 starts to turn to an enable-level signal, and the light emission control signals (Emit2, Emit3, . . . , Emit(N−1), EmitN) output from other shift register units are held as non-enable-level signals; at a time time moment T2, the light emission control signal Emit2 output from the second shift register unit 32 starts to turn to an enable-level signal, and the light emission control signals (Emit3, . . . , Emit(N−1), EmitN) output from other shift register units after the second shift register unit 32 are held as non-enable-level signals; at a time moment T3, the light emission control signal Emit3 output from the third shift register unit 33 starts to turn to an enable-level signal, and the light emission control signals ( . . . , Emit N−1, Emit N) output from other shift register units after the third shift register unit 33 are held as non-enable-level signals; at a time moment TN−1, the light emission control signal Emit N−1 output from the $(N-1)^{th}$-stage shift register unit 3N−1 starts to turn to an enable-level signal, and the light emission control signal output from the N-th shift register unit 3N after the $(N-1)^{th}$-stage shift register unit 3N−1 is held as a non-enable-level signal; at a time moment TN, the light emission control signal Emit N output from the N-th shift register unit 3N starts to turn to an enable-level signal; and after the time moment TN and before the starting moment of displaying the next frame of display images, the light emission control signals (Emit1, Emit2, Emit3, . . . , Emit (N−1), EmitN) output from the shift register units (31, 32, 33, . . . , 3N−1, 3N) may be held as enable-level signals. Among which, an enable-level light emission control signal is a signal that can control the first light emission control transistor in each pixel circuit 10 and the second light emission control transistor in each pixel circuit 10 to be turned on, and a non-enable-level light emission control signal is a signal that can control the first light emission control transistor in each pixel circuit 10 and the second light emission control transistor in each pixel circuit 10 to be turned off.

It is to be noted that the example in which a first light emission control transistor and a second light emission control transistor are P-type transistors are taken in embodiments of the present disclosure. Accordingly, an enable-level light emission control signal is a low-level signal, and a non-enable-level light emission control signal is a high-level signal. When a first light emission control transistor and a second light emission control transistor are N-type transistors, a non-enable-level light emission control signal is a low-level signal, and an enable-level light emission control signal is a high-level signal; and the technical principle, is similar to the technical principle in the case where a first light emission control transistor and a second light emission control transistor are P-type transistors and is not repeated herein.

Figure 7:
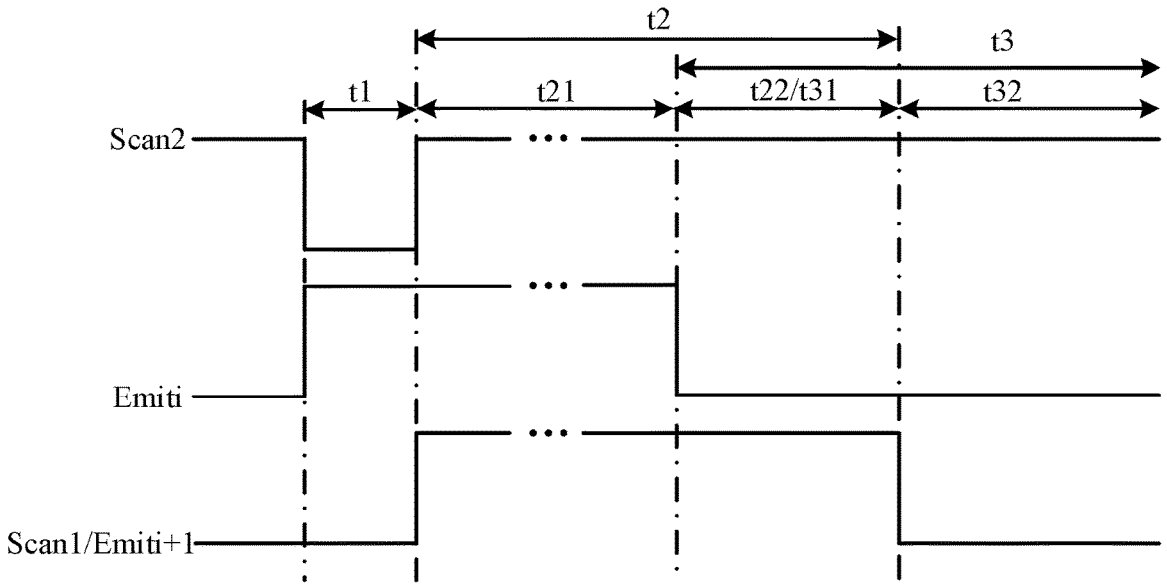
FIG. 7 is a driving timing diagram of the pixel circuit corresponding to FIG. 4.

As an example, a first light emission control transistor is a P-type transistor, and a first transistor is an N-type transistor. FIG. 7 is a driving timing diagram of the pixel circuit corresponding to FIG. 4. With combined reference to FIGS. 4, 5, and 7, the display region 101 includes multiple pixel circuits 10 in an array, multiple light emission control signal lines 302, and multiple first scan signal lines 303; the shift register units (31, 32, 33, . . . , 3N−1, 3N) are electrically connected to the light emission control signal lines 302 in a one-to-one manner; first light emission control terminals Emi of pixel circuits 10 disposed in a same row are electrically connected to a same shift register unit through a same light emission control signal line 302; first control terminals S1 of pixel circuits 10 disposed in a same row are electrically connected to a same shift register unit through a same first scan signal line 303. In a same pixel circuit 10, a shift register unit electrically connected to the first light emission control terminal Emi and a shift register unit electrically connected to the first control terminal S1 are adjacent shift register units; and in pixel circuits in two adjacent rows, a shift register unit electrically connected to first control terminals S1 of pixel circuits 10 in the previous row and a shift register unit electrically connected to first light emission control terminals Emi of pixel circuits 10 in the next row are a same shift register unit. In this case, in one pixel circuit 10, the first light emission control terminal Emi can receive the light emission control signal Emiti output from the i-th shift register unit, and the first control terminal S1 can receive the light emission control signal Emiti+1 output from the (i+1)-th shift register unit. With this arrangement, a light emission control driving circuit also serves as a driving circuit of a first control signal so that an additional scan driving circuit for supplying a first control signal to the first control terminal S1 of each pixel circuit 10 does not need to be disposed in the non-display region 102 of the display panel 100, reducing the number of driving circuits disposed in the non-display region 102 of the display panel 100, simplifying the structure of the display panel 100, reducing the size of the non-display region 102 of the display panel 100, and increasing the screen-to-body ratio of the display panel.

Moreover, when the first light emission control terminal Emi receives the light emission control signal Emiti output from the i-th shift register unit and the first control terminal S1 receives the light emission control signal Emiti+1 output from the (i+1)-th shift register unit, the leakage current alleviation stage t2 includes a first leakage current alleviation stage t21 disposed between the data writing stage t1 and the light emission stage t3 and a second leakage current alleviation stage t22 overlapping the light emission stage t3. Similarly, the light emission stage t3 includes a first light emission stage t31 overlapping the leakage current alleviation stage t2 and a second light emission stage t32 following the leakage current alleviation stage t2. In this case, the second leakage current alleviation stage t22 and the first light emission stage t31 are of a same stage. In the first leakage current alleviation stage t21, only the first transistor M1 is in the ON state so that the leakage current generated by the data writing transistor M2 can be transmitted to the first power supply terminal PVDD through the turned-on first transistor M1. In the second leakage current alleviation stage t22 and the first light emission stage t31, the first transistor M1, the first light emission control transistor M4, and the second light emission control transistor M5 are turned on simultaneously; the first transistor M1 and the first light emission control transistor M4 simultaneously transmit the power supply signal Vdd of the first power supply terminal PVDD to the first pole of the drive transistor T; and thus, the drive transistor T is in the ON state again and generates a drive current that is transmitted to the light-emitting element 20 through the turned-on second light emission control transistor M5, to drive the light-emitting element 20 to emit light. In the second light emission stage t32, the first transistor M1 is turned on; the first light emission control transistor M4 and the second light emission control transistor M5 keep in the ON state; the first light emission control transistor M4 continuously transmits the power supply signal Vdd of the first power supply terminal PVDD to the first pole of the drive transistor T; and the drive transistor T continuously supplies the drive current to the light-emitting element 20 so that the light-emitting element 20 emits light continuously. Among which, the overlapping period t22/t31 between the leakage current alleviation stage t2 and the light emission stage t3 is at least longer than or equal to a data writing stage of pixel circuits 10 in a next row so that a light emission stage of pixel circuits 10 in a next row is entered after the data writing stage of pixel circuits 10 in the next row is ended.

In some embodiments, with continued reference to FIGS. 4 and 5, when the pixel circuit 10 is applied to the display panel 100, the leakage current alleviation module 12 is further configured to transmit the leakage current generated by the data writing module 11 to the first power supply terminal PVDD in a pre-display stage of the display panel 100. Among which, the pre-display stage includes at least one data writing stage and at least one light emission stage, and a drive current generated by the drive transistor T in the at least one light emission stage of the pre-display stage is not supplied to the light-emitting element 20.

Figure 8:
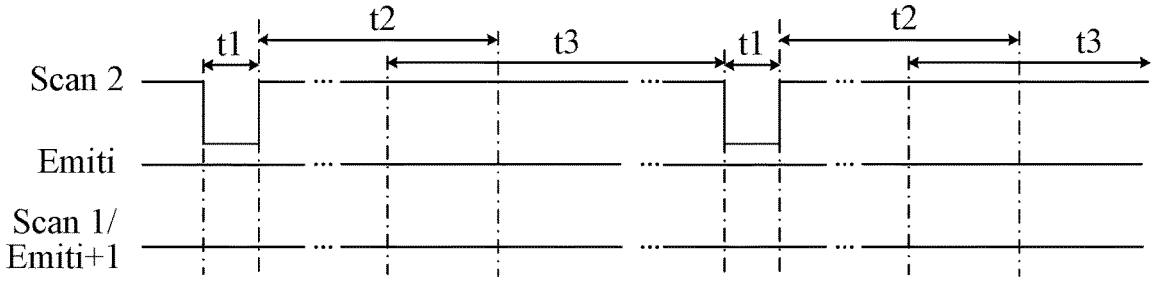
FIG. 8 is a driving timing diagram of a display panel according to embodiments of the present disclosure.

In some embodiments, FIG. 8 is a driving timing diagram of a display panel according to embodiments of the present disclosure. With combined reference to FIGS. 4, 5, and 8, the pre-display stage of the display panel 100 may be, for example, a start-up stage of the display panel 100. In the start-up of the display panel 100, the display panel 100 starts to be powered on; a driver chip (not shown in the figure) of the display panel 100 starts to supply a control signal to a corresponding driving circuit in the non-display region 102 and supply a data signal to each pixel circuit in the display region 101; and an instantaneous current in the display panel 100 is relatively large. In this case, the display panel 100 is in an unsteady stage. If the display panel 100 is directly controlled to display, the relatively large instantaneous current may affect the luminance of a light-emitting element 20 in the display panel 100 and may even break down each light-emitting element 20 in the display panel 100, Thus, destroying the display panel 100. To prevent the display panel 100 from being destroyed at the start-up moment of the display panel 100, under the control of a control signal supplied by the driver chip, each shift register unit 301 in the light emission control driving circuit 30 may continuously output a non-enable-level light emission control signal Emit so that the light emission control module 14 in each pixel circuit 10 is in the OFF state, and a current signal is not supplied to a light-emitting element 10 through a light emission control module 14. Moreover, a data signal supplied by the driver chip is a data signal corresponding to a black image; that is, the data signal Vdata is an AVDD or a VGMP. Under the control of a control signal supplied by the driver chip, a driving circuit (not shown in the figure) supplying a second control signal Scan2 may supply an enable-level second control signal Scan2 to the second control terminal S2 of pixel circuits 10 in each row so that Data writing modules 11 of pixel circuits 10 in each row are turned on sequentially, and a data signal Vdata corresponding to a black image is written to gates of drive transistors T of pixel circuits 10 in each row sequentially. After one or more display image frames, the display panel 100 may reach a steady state. In this case, the display panel 100 may be controlled to display normally. This process is a black frame insertion process in the start-up of the display panel 100.

In the black frame insertion process in the start-up of the display panel 100, the leakage current alleviation module 12 of each pixel circuit 10 is controlled to stay in the ON state so that the leakage current generated by the data writing module 11 in a non-data-writing stage can be transmitted to the first power supply terminal PVDD through the turned-on leakage current alleviation module 12, but would not be transmitted to the light-emitting element 20, preventing the light-emitting element 20 through the light emission control module 15, to prevent light emitting due to the light emission control module 15 leaking the leakage current generated by the data writing module 11 to the light-emitting element 20 in the black frame insertion process in the start-up of the display panel 100, and thus, avoiding the phenomenon of a flickering screen in the start-up of the display panel 100. That is, the problem of a flickering screen in the start-up is solved by controlling the leakage current alleviation module 12 of each pixel circuit 10 to stay in the ON state in the black frame insertion process in the start-up of the display panel 100.

It is to be noted that FIG. 4 is only an exemplary drawing of embodiments of the present disclosure. FIG. 4 only exemplarily illustrates that the first light emission control transistor M4 and the first transistor M1 are a P-type transistor and an N-type transistor respectively. When the channel type of the first light emission control transistor M4 is different from the channel type of the first transistor M1, the first light emission control transistor M4 and the first transistor M1 may be arranged as an N-type transistor and a P-type transistor respectively. This is not specifically limited in embodiments of the present disclosure. For ease of description, the example in which the first light emission control transistor M4 and the first transistor M1 are a P-type transistor and an N-type transistor respectively is taken for exemplarily describing technical solutions in embodiments of the present disclosure hereinafter.

Figure 9:
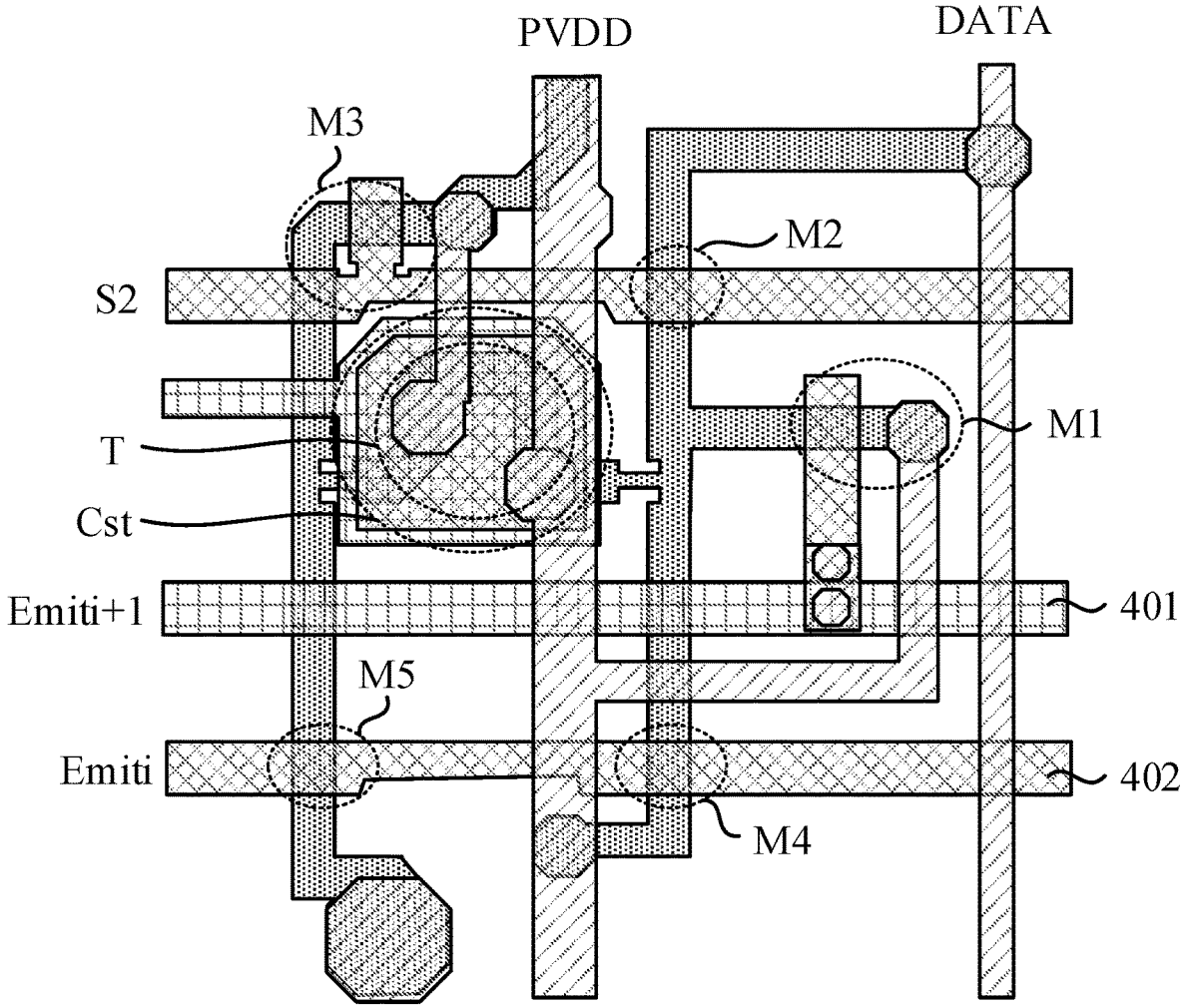
FIG. 9 is a top view of a pixel circuit according to embodiments of the present disclosure.
Figure 10:
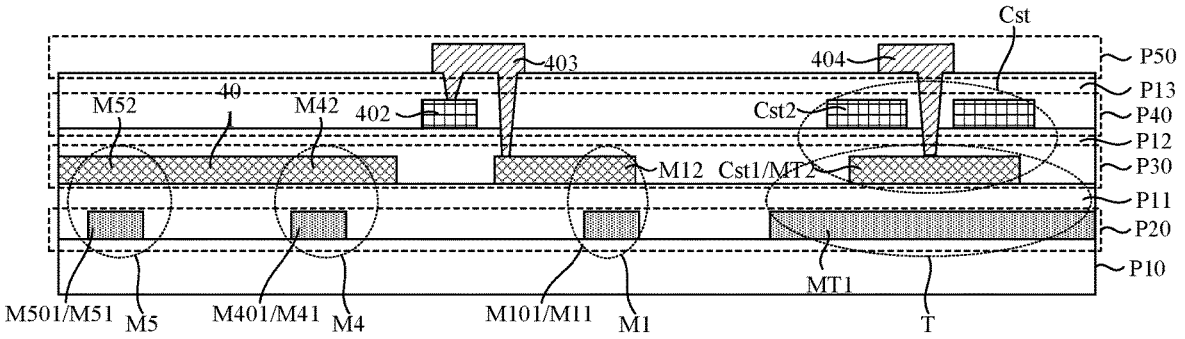
FIG. 10 is a schematic layer diagram of a pixel circuit according to embodiments of the present disclosure.

In some embodiments, FIG. 9 is a top view of a pixel circuit according to embodiments of the present disclosure, and FIG. 10 is a schematic layer diagram of a pixel circuit according to embodiments of the present disclosure. With combined reference to FIGS. 4, 9, and 10, the pixel circuit includes a base substrate P10 and a semiconductor layer P20 disposed on a side of the base substrate P10; the semiconductor layer P20 includes an active layer M11 of the first transistor M1, an active layer M41 of the first light emission control transistor M4, and an active layer M51 of the second light emission control transistor M5; the active layer M41 of the first light emission control transistor M4 includes a first channel region M401; the active layer M51 of the second light emission control transistor M5 includes a second channel region M501; the active layer of the first transistor M1 includes a third channel region M101; and a doping type of the first channel region M401 is same as a doping type of the second channel region M501 and different from a doping type of the third channel region M101.

With this arrangement, under the premise that the active layer M11 of the first transistor M1, the active layer M41 of the first light emission control transistor M4, and the active layer M51 of the second light emission control transistor M5 are disposed in a same layer, a channel type of the first transistor M1 may be different from the channel type of the first light emission control transistor M4 and may be same as a channel type of the second light emission control transistor M5, simplifying processes, simplifying the layer structure in the pixel circuit, and facilitating the thinning of the display panel when the pixel circuit is applied in a display panel.

In some embodiments, with combined reference to FIGS. 4, 9, and 10, the pixel circuit further includes a first metal layer P30 disposed on a side of the semiconductor layer P20 facing away from the base substrate P10 and a second metal layer P40 disposed on a side of the first metal layer P30 facing away from the base substrate P10; the first metal layer P30 includes the gate M12 of the first transistor M1, the gate M42 of the first light emission control transistor M4, the gate M52 of the second light emission control transistor M5, and a first connection line 401. The gate M42 of the first light emission control transistor M4 and the gate M52 of the second light emission control transistor M5 are electrically connected to the first light emission control terminal Emi through the first connection line 401. The gate M42 of the first light emission control transistor M4, the gate M52 of the second light emission control transistor M5, and the first connection line 401 are an integrated structure. The second metal layer P40 includes a second connection line 402; and the gate M12 of the first transistor M1 is electrically connected to the second connection line 402 through a via hole and electrically connected to the first control terminal S1 through the second connection line 402.

With this arrangement, the gate M12 of the first transistor M1, the gate M42 of the first light emission control transistor M4, the gate M52 of the second light emission control transistor M5 are all disposed in the first metal layer P30 so that the gate M12 of the first transistor M1, the gate M42 of the first light emission control transistor M4, the gate M52 of the second light emission control transistor M5 may be formed using the same material in the same process, simplifying processes for manufacturing the pixel circuit 10 and reducing the cost of the pixel circuit. Moreover, the first connection line electrically connecting the first light emission control terminal Emi to the gate M42 of the first light emission control transistor M4 and the gate M52 of the second light emission control transistor M5 is disposed in the first metal layer P30, and the second connection line 402 electrically connecting the first control terminal S1 to the gate M12 of the first transistor M1 is disposed in the second metal layer P40. That is, the first connection line 401 and the second connection line 402 are disposed in different metal layers so that the light emission control signal transmitted by the first connection line 401 and the first control signal transmitted by the second connection line 402 are prevented from affecting each other due to a relatively short distance between the first connection line 401 and the second connection line 402 when the first connection line 401 and the second connection line 402 are disposed in the same layer. Moreover, the arrangement in which the first connection line 401 and the second connection line 402 are disposed in different metal layers further shortens the distance between the first connection line 401 and the second connection line 402 in the direction parallel to the plane in which the base substrate P10 is located, reduces the area occupied by the pixel circuit 10, and thus, enhancing the resolution of the display panel when the pixel circuit 10 is applied in a display panel.

In some embodiments, with continued reference to FIGS. 4, 9, and 10, the semiconductor layer P20 further includes an active layer MT1 of the drive transistor T when the pixel circuit 10 includes the storage capacitor Cst, the first plate Cst1 of the storage capacitor Cst is electrically connected to the gate MT2 of the drive transistor T, and the second plate Cst2 of the storage capacitor Cst is electrically connected to the first power supply terminal PVDD; the first metal layer P30 further includes the first plate Cst1 of the storage capacitor Cst and the gate MT2 of the drive transistor T; and the second metal layer P40 includes the second plate Cst2 of the storage capacitor Cst.

With this arrangement, the active layer MT1 of the drive transistor T and the first light emission control transistor M4 are both disposed in the semiconductor layer P20; and when the channel type of the drive transistor T is the same as the channel type of the first light emission control transistor M4, the active layer MT1 of the drive transistor T and the first light emission control transistor M4 may be formed using the same material in the same process. Moreover, the arrangement in which the second plate Cst2 of the storage capacitor Cst and the second connection line 402 are both disposed in the second metal layer P40 enables the second plate Cst2 of the storage capacitor Cst and the second connection line 402 to be formed using the same material in the same process, simplifying the process for manufacturing the pixel circuit 10 and reducing the cost for manufacturing the pixel circuit 10. Moreover, when the first plate Cst1 of the storage capacitor Cst is electrically connected to the gate MT2 of the drive transistor T and when the first plate Cst1 of the storage capacitor Cst and the gate MT2 of the drive transistor T are both disposed in the first metal layer P30, the first plate Cst1 of the storage capacitor Cst and the gate MT2 of the drive transistor T may be an integrated structure.

Additionally, the pixel circuit 10 may further include a fourth metal layer P50 that may be disposed on a side of the second metal layer P40 facing away from the base substrate P10. The fourth metal layer P50 may include joint structures (403 and 404) so that element structures in different layers and at different positions are electrically connected to each other. For example, the gate M12 of the first transistor M1 may be electrically connected to a joint structure 403 through a via hole and then the joint structure 403 is electrically connected to the second connection line 402 through a via hole so that the gate M12 of the first transistor M1 is electrically connected to the second connection line 402. Similarly, the gate of the drive transistor T may be electrically connected to another structure (for example, the second pole of the threshold compensation transistor M3) through a joint structure 404. Moreover, an insulating layer (P11, P12, or P13) is disposed between two adjacent function layers so that different function layers are insulated from each other. For example, an insulating layer P11 is disposed between the semiconductor layer P20 and the first metal layer P30; an insulating layer P12 is disposed between the first metal layer P30 and the second metal layer P40; and an insulating layer P13 is disposed between the second metal layer P40 and the fourth metal layer P50.

It is to be understood that each transistor in FIGS. 9 and 10 is a top-gate structure where the gate is disposed on a side of the active layer facing away from the base substrate. In embodiments of the present disclosure, each transistor may be a bottom-gate structure where the active layer is disposed on a side of the gate facing away from the base substrate. In other embodiments, some transistors may be top-gate structures, some transistors bottom-gate structures, and some transistors double-gate structures. For a double-gate structure, the two gates may be disposed in the same layer or on two opposite sides of the active layer. The gate structure of a transistor is not specifically limited in embodiments of the present disclosure.

It is to be noted that FIGS. 9 and 10 only exemplarily illustrate the relative positional relationship between function layers in the pixel circuit and the arrangement of each transistor and storage capacitor. In embodiments of the present disclosure, the arrangement of each function layer in the pixel circuit is not limited here and may be in another form; and in this case, the arrangement of each transistor in the pixel circuit may be different from the preceding arrangement.

Figure 11:
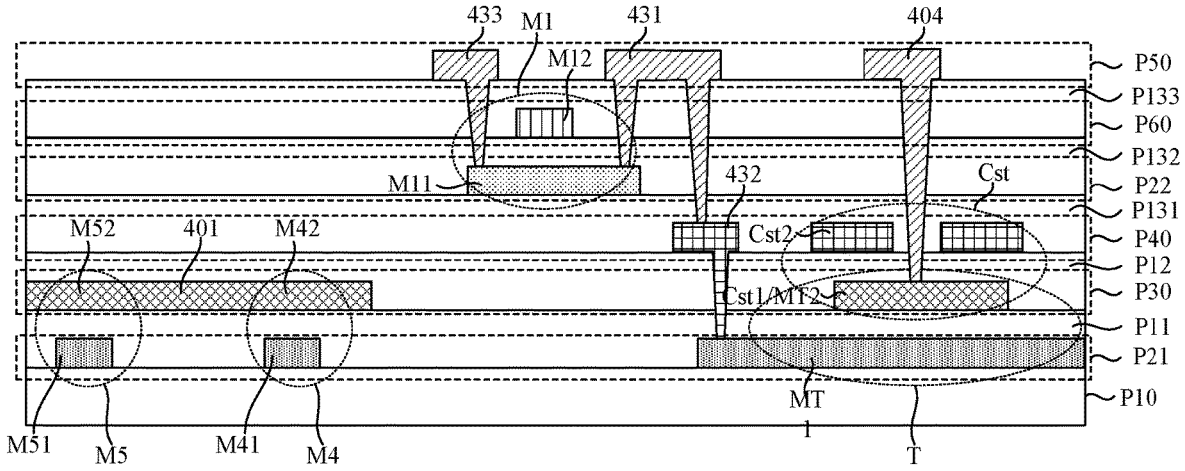
FIG. 11 is another schematic layer diagram of a pixel circuit according to embodiments of the present disclosure.

In some embodiments, FIG. 11 is another schematic layer diagram of a pixel circuit according to embodiments of the present disclosure. With combined reference to FIGS. 4 and 11, the pixel circuit 10 includes a base substrate P10, a first semiconductor layer P21 disposed on a side of the base substrate P10, and a second semiconductor layer P22 disposed on a side of the first semiconductor layer P21 facing away from the base substrate P10. In this case, the first semiconductor layer P21 includes the active layer M41 of the first light emission control transistor M4 and the active layer M51 of the second light emission control transistor M5, and the second semiconductor layer P22 includes an active layer M11 of the first transistor M1.

With this arrangement, for the first transistor M1 and the first light emission control transistor M4 with different channel types, the active layer M11 of the first transistor M1 and the active layer M41 of the first light emission control transistor M4 are disposed in different semiconductor layers (the first semiconductor layer P21 and the second semiconductor layer P22); while for the first light emission control transistor M4 and the second light emission control transistor M5 with the same channel type, the active layer M41 of the first light emission control transistor M4 and the active layer M51 of the second light emission control transistor M5 are disposed in the same layer. Accordingly, active layers of transistors with different channel types are manufactured using different materials; while active layers of transistors with the same channel type are manufactured using the same material. Among which, when the first transistor M1 and the first light emission control transistor M4 are an N-type transistor and a P-type transistor respectively, a material of the first semiconductor layer may include, but is not limited to, a low-temperature polycrystalline silicon material; and a material of the second semiconductor layer P22 may include, but is not limited to, an oxide semiconducting material, for example, indium zinc oxide, indium gallium zinc oxide, indium tin oxide, or indium gallium tin oxide.

In some embodiments, with continued reference to FIGS. 4 and 11, the pixel circuit 10 further includes a first metal layer P30 disposed on a side of the first semiconductor layer P21 facing away from the base substrate P10 and a third metal layer P60 disposed on a side of the second semiconductor layer P22 facing away from the base substrate P10; the first metal layer P30 includes the gate M42 of the first light emission control transistor M4 and the gate M52 of the second light emission control transistor M5; and the third metal layer P60 includes the gate M12 of the first transistor M1.

With this arrangement, for the first light emission control transistor M4 and the second light emission control transistor M5 with the same channel type, the gate M42 of the first light emission control transistor M4 and the gate M52 of the second light emission control transistor M5 are both disposed in the first metal layer P30, and the gate M42 of the first light emission control transistor M4, the gate M52 of the second light emission control transistor M5, and the first connection line 401 are an integrated structure; while for the first transistor M1 and the first light emission control transistor M4 with different channel types, the gate M12 of the first transistor M1 and the gate M42 of the first light emission control transistor M4 are disposed in the third metal layer P60 and the first metal layer P30 respectively, preventing the control signal (the first control signal) received by the gate M12 of the first transistor M1 and the control signal (the first light emission control signal) received by the gate M42 of the first light emission control transistor M4 from interfering with each other. Moreover, the arrangement in which transistors with different channel types are disposed in different metal layers shortens the distance between gates in different metal layers in the direction parallel to the plane in which the base substrate P10 is located, reduces an area occupied by the pixel circuit 10, and thus, enhances the resolution of the display panel when the pixel circuit 10 is applied in a display panel.

It is to be understood that for the similarities between FIG. 11 and FIG. 9, refer to the preceding description of FIG. 9, which is not repeated herein. Only the differences between FIG. 11 and FIG. 9 are exemplarily described here. With continued reference to FIGS. 4 and 11, the second semiconductor layer P22 may be disposed on a side of the first metal layer P30 and the second metal layer P40 facing away from the base substrate P10, and the fourth metal layer P50 may be disposed on a side of the third metal layer P60 facing away from the base substrate P10. In this case, an insulating layer P131 needs to be disposed between the second semiconductor layer P22 and the second metal layer P40; an insulating layer P132 needs to be disposed between the second semiconductor layer P22 and the third metal layer P60; and an insulating layer P133 needs to be disposed between the third metal layer P60 and the fourth metal layer P50. Moreover, when the active layer M11 of the first transistor M1 and an active layer of another transistor (for example, the data writing transistor M2 or the drive transistor T) are disposed in different layers, the second pole of the first transistor M1 may be electrically connected to another transistor through joint structures (431 and 432). Moreover, when the fourth metal layer P50 includes a connection line 433 for transmitting the power supply signal Vdd, the first transistor M1 may be electrically connected to the connection line 433 through a via hole and then electrically connected to the first power supply terminal PVDD through the connection line 433.

Figure 12:
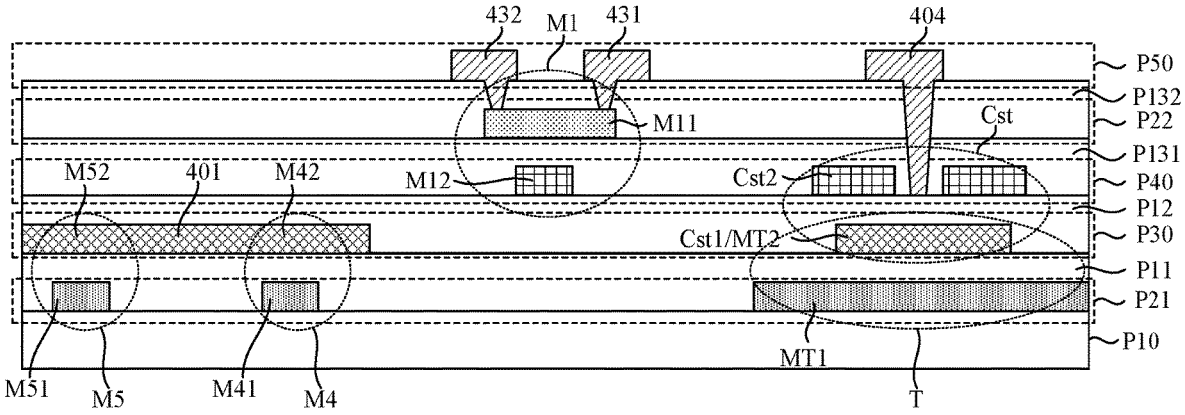
FIG. 12 is another schematic layer diagram of a pixel circuit according to embodiments of the present disclosure.

Moreover, in other embodiments, as shown in FIG. 12, the gate M11 of the first transistor M1 may further be disposed in the same layer as the second plate Cst2 of the storage capacitor Cst; that is, the second metal layer P40 may include the gate M12 of the first transistor M1 and the second plate Cst2 of the storage capacitor Cst.

It is to be noted that the preceding description for exemplarily describing embodiments of the present disclosure takes an example in which the leakage current alleviation module of the pixel circuit is directly electrically connected to the data writing module of the pixel circuit and in which the leakage current alleviation module and the data writing module are each electrically connected to the first pole of the drive transistor at a second connection node N2. In embodiments of the present disclosure, the leakage current alleviation module may also be electrically connected to another module and perform the function of transmitting the leakage current generated by the data writing module to the first power supply terminal.

Figure 13:
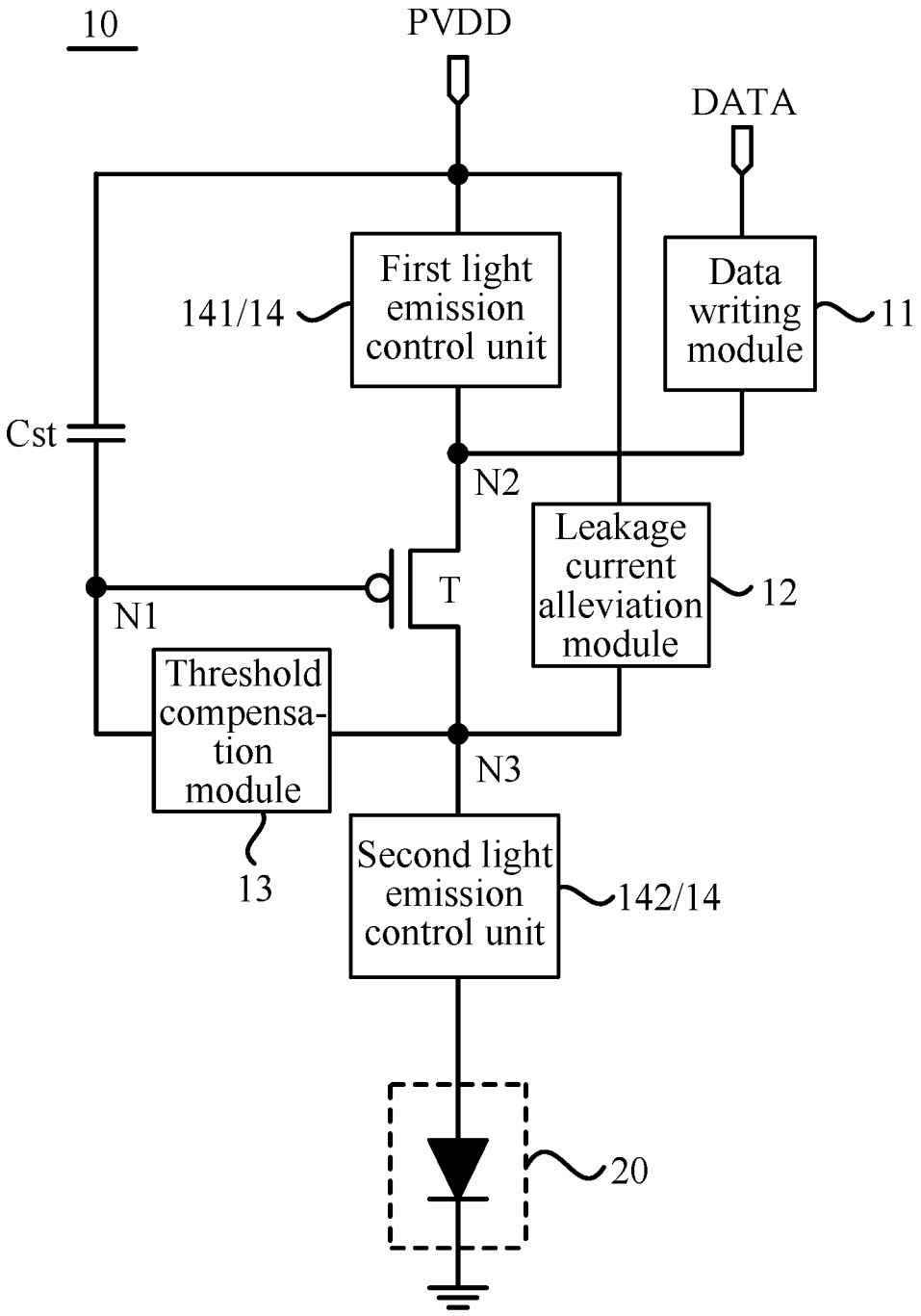
FIG. 13 is another schematic diagram of a pixel circuit according to embodiments of the present disclosure.

In some embodiments, FIG. 13 is another schematic diagram of a pixel circuit according to embodiments of the present disclosure. Referring to FIG. 13, when the pixel circuit includes the threshold compensation module 13, the first terminal of the leakage current alleviation module 12 is electrically connected to the first power supply terminal PVDD, the second terminal of the leakage current alleviation module 12 is electrically connected to the first terminal of the threshold compensation module 13, and the second terminal of the threshold compensation module 13 is electrically connected to the gate of the drive transistor T. In this case, in the leakage current alleviation stage, when the leakage current generated by the data writing module 11 is transmitted to the first terminal of the threshold compensation module 13 through the drive transistor T, the leakage current alleviation module 12 can transmit the leakage current to the first power supply terminal PVDD to prevent the leakage current from being transmitted to the gate of the drive transistor T, affecting the gate voltage of the drive transistor T, or affecting the drive current generated by the drive transistor T in the light emission stage. Thus, the luminance accuracy of the light-emitting element 20 is enhanced so that the display effect of the display panel is improved when the pixel circuit 10 is applied in a display panel.

Figure 14:
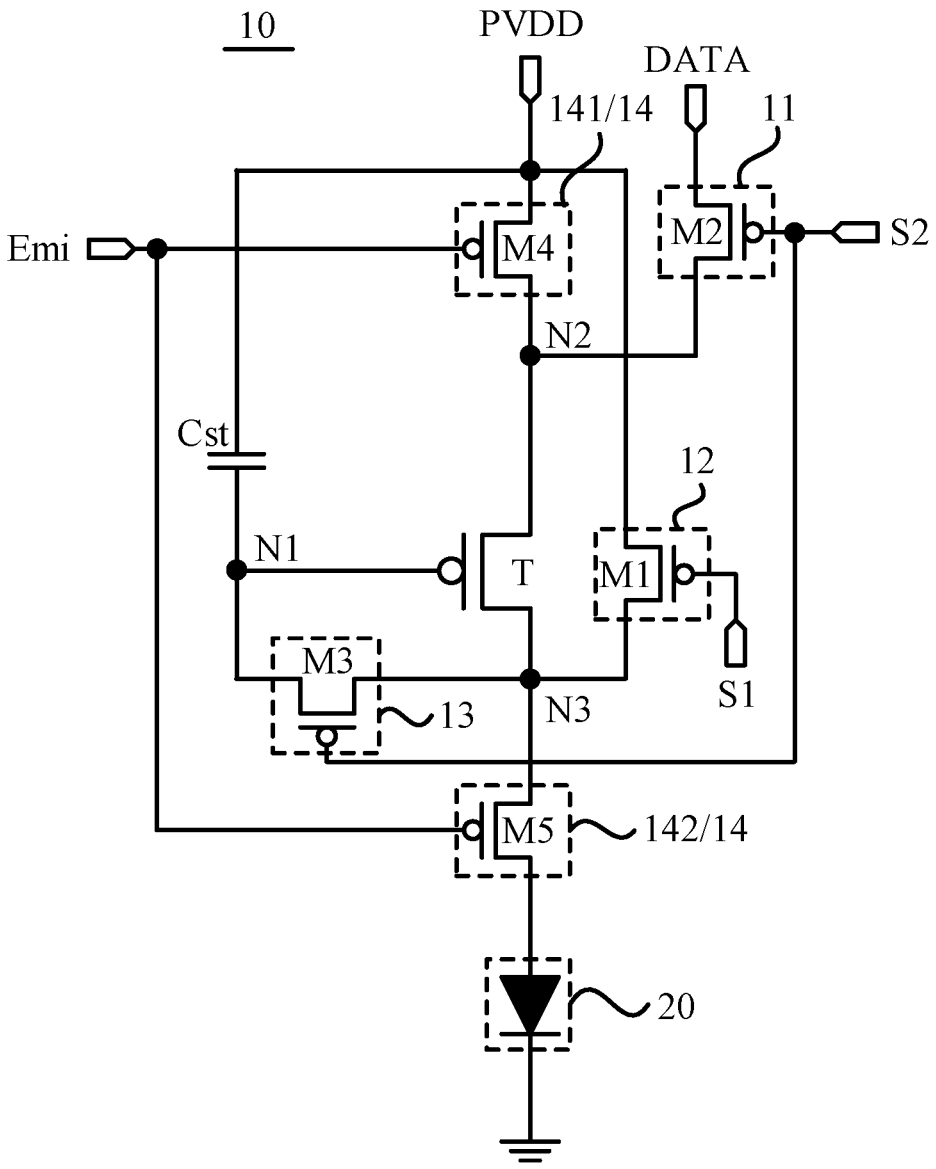
FIG. 14 is another schematic circuit diagram of a pixel circuit according to embodiments of the present disclosure.

In some embodiments, FIG. 14 is another schematic circuit diagram of a pixel circuit according to embodiments of the present disclosure. As shown in FIG. 14, the leakage current alleviation module 12 may include the first transistor M1. In such a way, the pixel circuit 10 further includes the first control terminal S1; the first pole of the first transistor M1 is electrically connected to the first power supply terminal PVDD; the second pole of the first transistor M1 is electrically connected to the first terminal of the threshold compensation module 13; and the gate M12 of the first transistor M1 is electrically connected to the first control terminal S1. With this arrangement, the first transistor M1 can be turned on or off under the control of the first control signal of the first control terminal S1; and in the leakage current alleviation stage, the first control signal of the first control terminal S needs to control the first transistor M1 to be turned on so that the leakage current generated by the data writing module 11, when transmitted to a third connection node N3, can be transmitted to the first power supply terminal PVDD through the turned-on first transistor M1.

Figure 15:
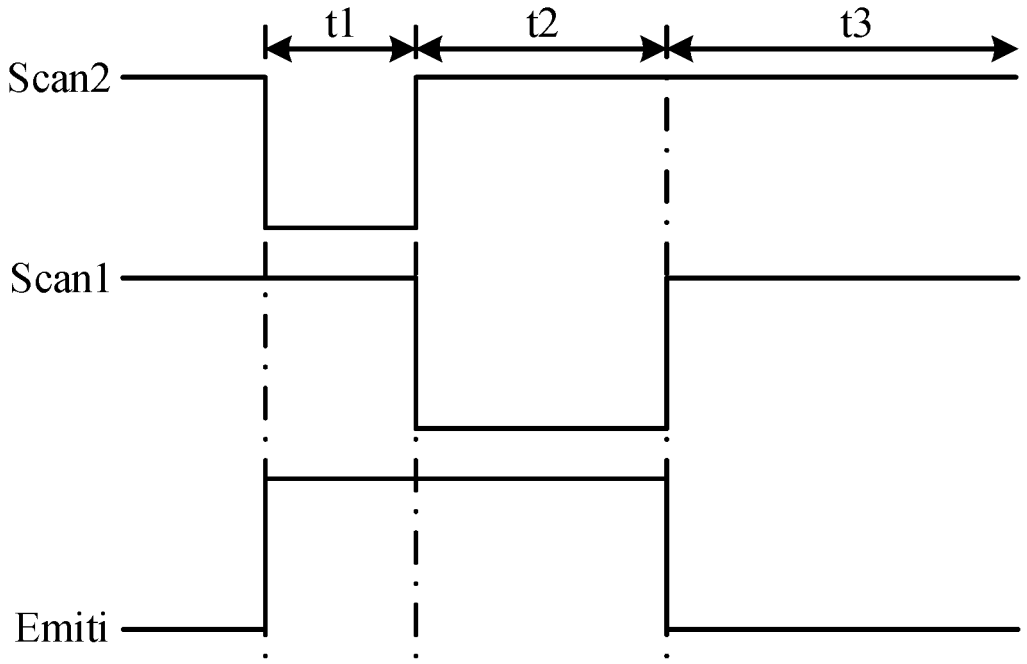
FIG. 15 is a driving timing diagram of the pixel circuit corresponding to FIG. 14.

As an example, FIG. 15 is a driving timing diagram of the pixel circuit corresponding to FIG. 14. With combined reference to FIGS. 14 and 15, an example is taken in which the data writing module 12 includes the data writing transistor M2, in which the threshold compensation module 13 includes the threshold compensation transistor M3, in which the light emission control module 14 includes the first light emission control transistor M4 and the second light emission control transistor M5, and in which transistors in the pixel circuit are P-type transistors. In the data writing stage t1, the data writing transistor M2 and the threshold compensation transistor M3 are in the ON state, and the first transistor M1, the first light emission control transistor M4, and the second light emission control transistor M5 are in the OFF state; accordingly, the data signal Vdata of the data signal terminal DATA can pass through the data writing transistor M2, the drive transistor T, and the threshold compensation transistor M3 sequentially to be written to the gate of the drive transistor T and compensate the threshold voltage Vth of the drive transistor T to the gate of the drive transistor T so that the gate potential of the drive transistor T is a sum of the data signal Vdata and the threshold voltage Vth. In the leakage current alleviation stage t2, the first transistor M1 is in the ON state, and the data writing transistor M2, the threshold compensation transistor M3, the first light emission control transistor M4, and the second light emission control transistor M5 are in the OFF state. In this case, the first transistor M1 is in the low-resistance state, and other transistors (the data writing transistor M2, the threshold compensation transistor M3, the first light emission control transistor M4, and the second light emission control transistor M5) are all in the high-resistance state; accordingly, when transmitted to the third node N3, the leakage current generated by the data writing module 11 can be transmitted to the first power supply terminal PVDD through the first transistor M1 in the low-resistance state, but would not be transmitted to the gate of the drive transistor T through the threshold compensation transistor M3 in the high-resistance state, or would not transmitted to the light-emitting element 20 through the second light emission control transistor M5 in the high-resistance state. In this case, under the premise of guaranteeing the accuracy of the gate voltage of the drive transistor T, the phenomenon of the pixel to be turned on abnormally is avoided. In the light emission stage t3, the first light emission control transistor M4 and the second light emission control transistor M5 are in the ON state, and the first transistor M1, the data writing transistor M2, and the threshold compensation transistor M3 are in the OFF state; accordingly, the power supply signal of the first power supply terminal PVDD can be transmitted to the first pole of the drive transistor T through the first light emission control transistor M4 so that the drive transistor T generates a corresponding drive current that can be supplied through the second light emission control transistor M5 to the light-emitting element 20 to drive the light-emitting element 20 to emit light.

In some embodiments, with continued reference to FIGS. 14 and 15, the second terminal of the leakage current alleviation module 12, the first terminal of the threshold compensation module 13, and the second pole of the drive transistor T are electrically connected at a third node N3. To prevent a signal transmitted by the leakage current alleviation module 12 from affecting the luminance effect of the light-emitting element 20 in the light emission stage, the leakage current alleviation stage t2 and the light emission stage t3 may not overlap each other; that is, the leakage current alleviation stage t2 is only configured between the data writing stage t1 and the light emission stage t3.

It is to be noted that the two connection manners of the leakage current alleviation module in the preceding embodiments are only exemplary connection manners in embodiments of the present disclosure. On the basis that the leakage current alleviation module can transmit the leakage current generated by the data writing module to the first power supply terminal in the leakage current alleviation stage, the connection manner of the leakage current alleviation module is not specifically limited in embodiments of the present disclosure. For ease of description, unless otherwise specified, an example in which the leakage current alleviation module is directly electrically connected to the data writing module is taken in embodiments of the present disclosure for exemplarily describing technical solutions in embodiments of the present disclosure.

Figure 16:
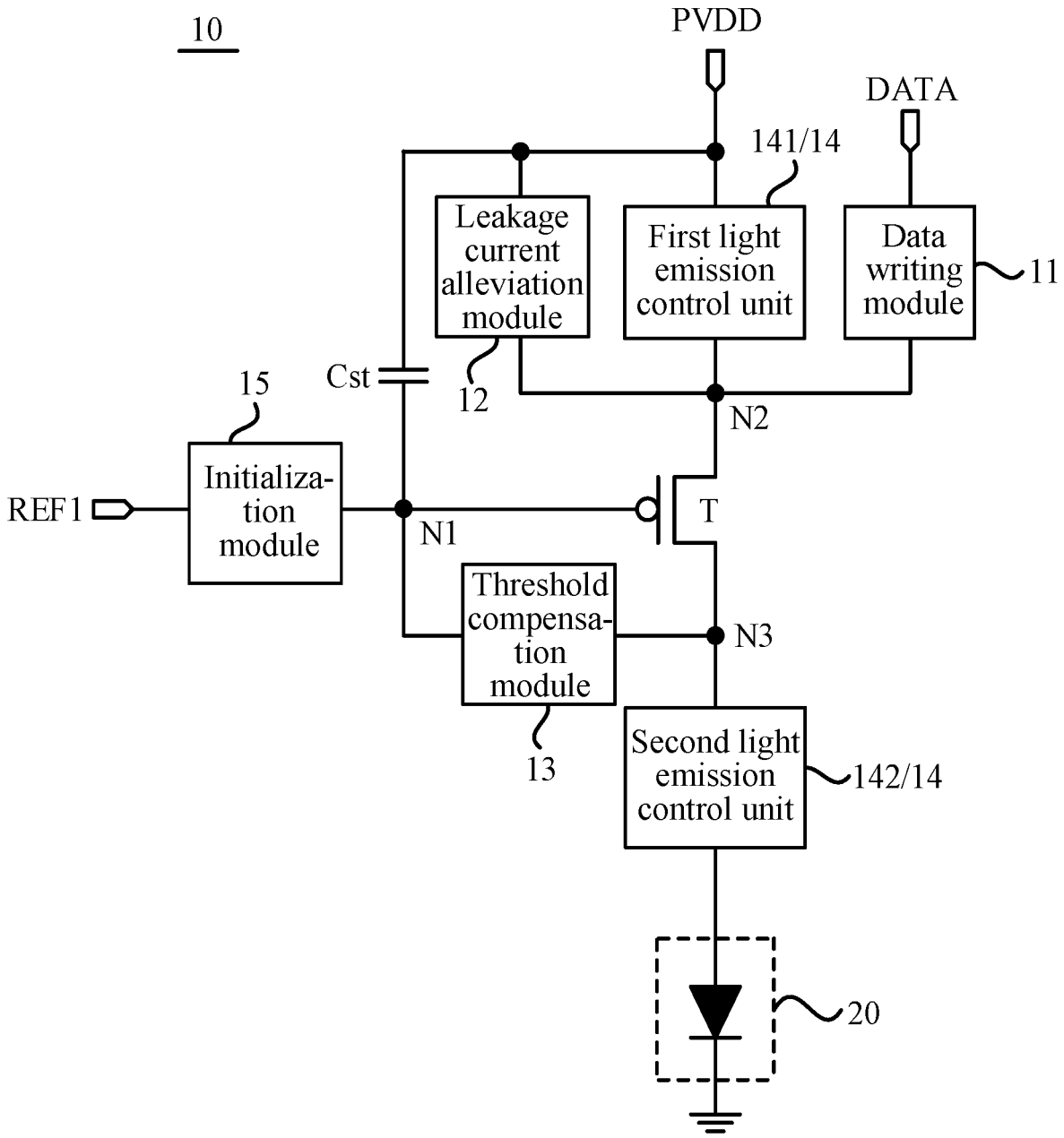
FIG. 16 is another schematic diagram of a pixel circuit according to embodiments of the present disclosure.

In some embodiments, FIG. 16 is another schematic diagram of a pixel circuit according to embodiments of the present disclosure. As shown in FIG. 16, the pixel circuit 10 further includes an initialization signal terminal REF1 and an initialization module 15. The initialization module 15 is electrically connected to the initialization signal terminal REF1 and the gate of the drive transistor T; and the initialization module 15 is configured to transmit an initialization signal Vref1 of the initialization signal terminal REF1 to the gate of the drive transistor T in an initialization stage to initialize the gate of the drive transistor T. Among which, the initialization stage is located before the data writing stage. With this arrangement, before the data writing stage, the initialization module 15 initializes the gate of the drive transistor T to erase a gate potential of the drive transistor T in a previous drive cycle, to ensure that the drive transistor T keeps in the ON state in the data writing stage of the current drive cycle, and to facilitate the data writing of the data signal Vdata of the data signal terminal DATA.

Figure 17:
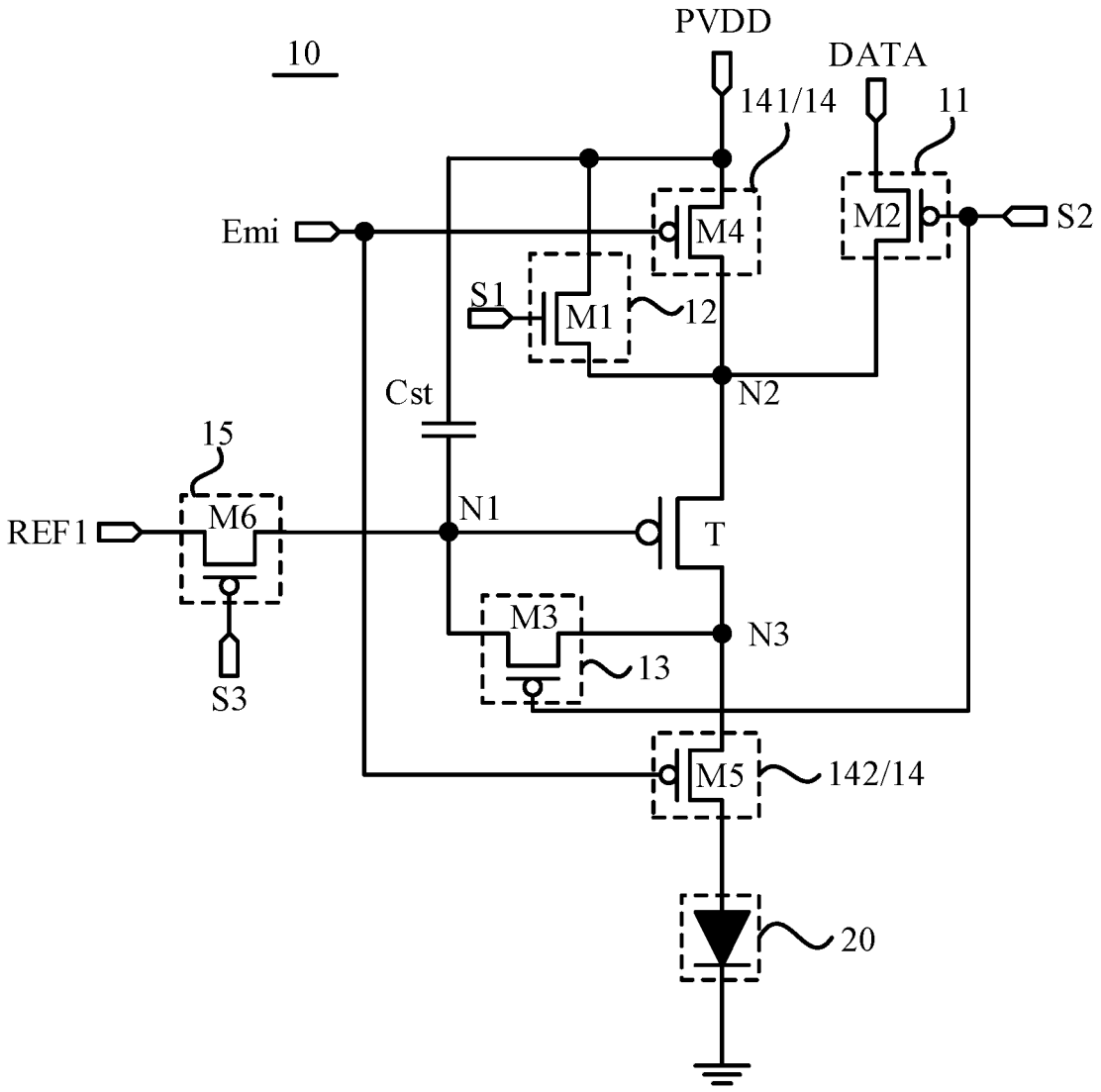
FIG. 17 is another schematic circuit diagram of a pixel circuit according to embodiments of the present disclosure.

As an example, FIG. 17 is another schematic circuit diagram of a pixel circuit according to embodiments of the present disclosure. As shown in FIG. 17, the initialization module 15 may include an initialization transistor M6. In this case, the pixel circuit 10 may further include a third control terminal S3; a first pole of the initialization transistor M6 is electrically connected to the initialization signal terminal REF1; a second pole of the initialization transistor M6 is electrically connected to the gate of the drive transistor T at the first connection node N1; and the gate of the initialization transistor M6 is electrically connected to the third control terminal S3. With this arrangement, a third control signal Scan3 of the third control terminal S3 can control the initialization transistor M6 to be turned on or off; and when being turned on, the initialization transistor M6 can transmit the initialization signal Vref1 of the initialization signal terminal REF1 to the gate of the drive transistor T to initialize the gate of the drive transistor T. Among which, the initialization transistor M6 may be an N-type transistor or a P-type transistor, which is not specifically limited in embodiments of the present disclosure.

Figure 18:
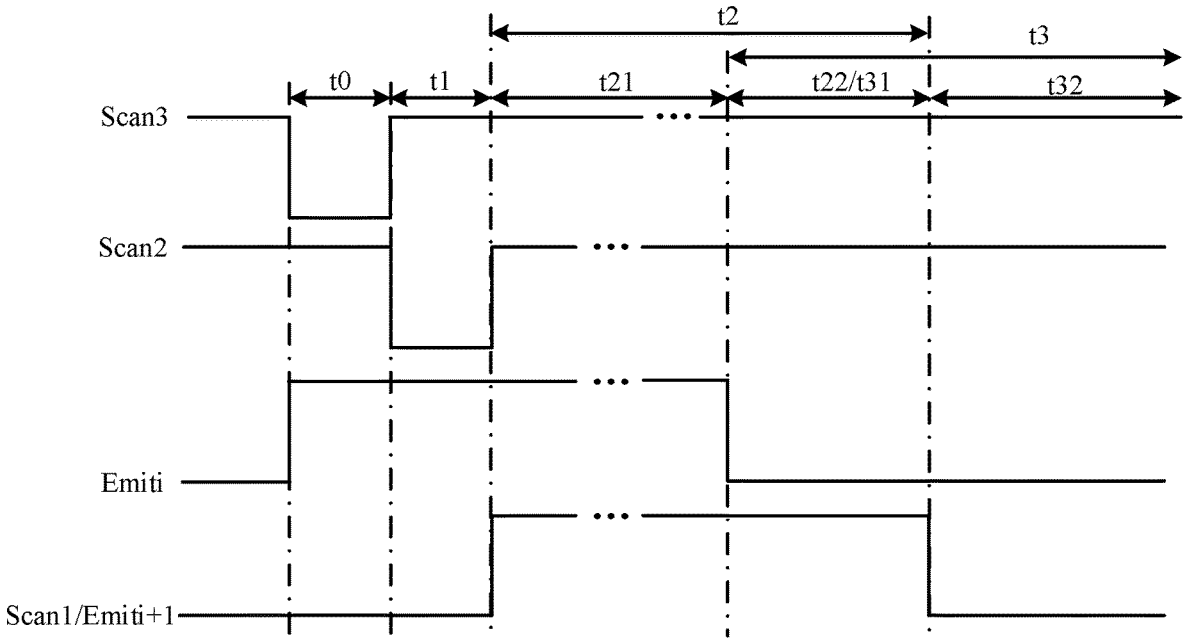
FIG. 18 is a driving timing diagram of the pixel circuit corresponding to FIG. 17.

An example is taken in which all transistors except the first transistor M1 in the pixel circuit are P-type transistors. FIG. 18 is a driving timing diagram of the pixel circuit corresponding to FIG. 17. With combined reference to FIGS. 17 and 18, in the initialization stage t0, the third control signal Scan3 of the third control terminal S3 is a low-level signal so that the P-type initialization transistor M6 is in the ON state; the first control signal Scant of the first control terminal S1 is also a low-level signal so that the N-type first transistor M1 is in the OFF state; the first light emission control signal Emiti of the first light emission control terminal Emi and the second control signal Scan2 of the second control terminal S2 are both high high-level signals so that the P-type first light emission control transistor M4, the P-type second light emission control transistor M5, the P-type second data writing transistor M2, and the P-type threshold compensation transistor M3 are all in the OFF state; and the initialization signal Vref1 of the initialization signal terminal REF1 is transmitted to the gate of the drive transistor T through the initialization transistor M6, to initialize the gate of the drive transistor T. In the data writing stage t1, the leakage current alleviation stage t2, and the light emission stage t3, the third control signal Scan3 is held as a high-level signal so that the initialization transistor M6 keeps in the OFF state. The ON or OFF states of other transistors are same as the preceding description of the data writing stage t1, the leakage current alleviation stage t2, and the light emission stage t3, which is not repeated herein.

Figure 19:
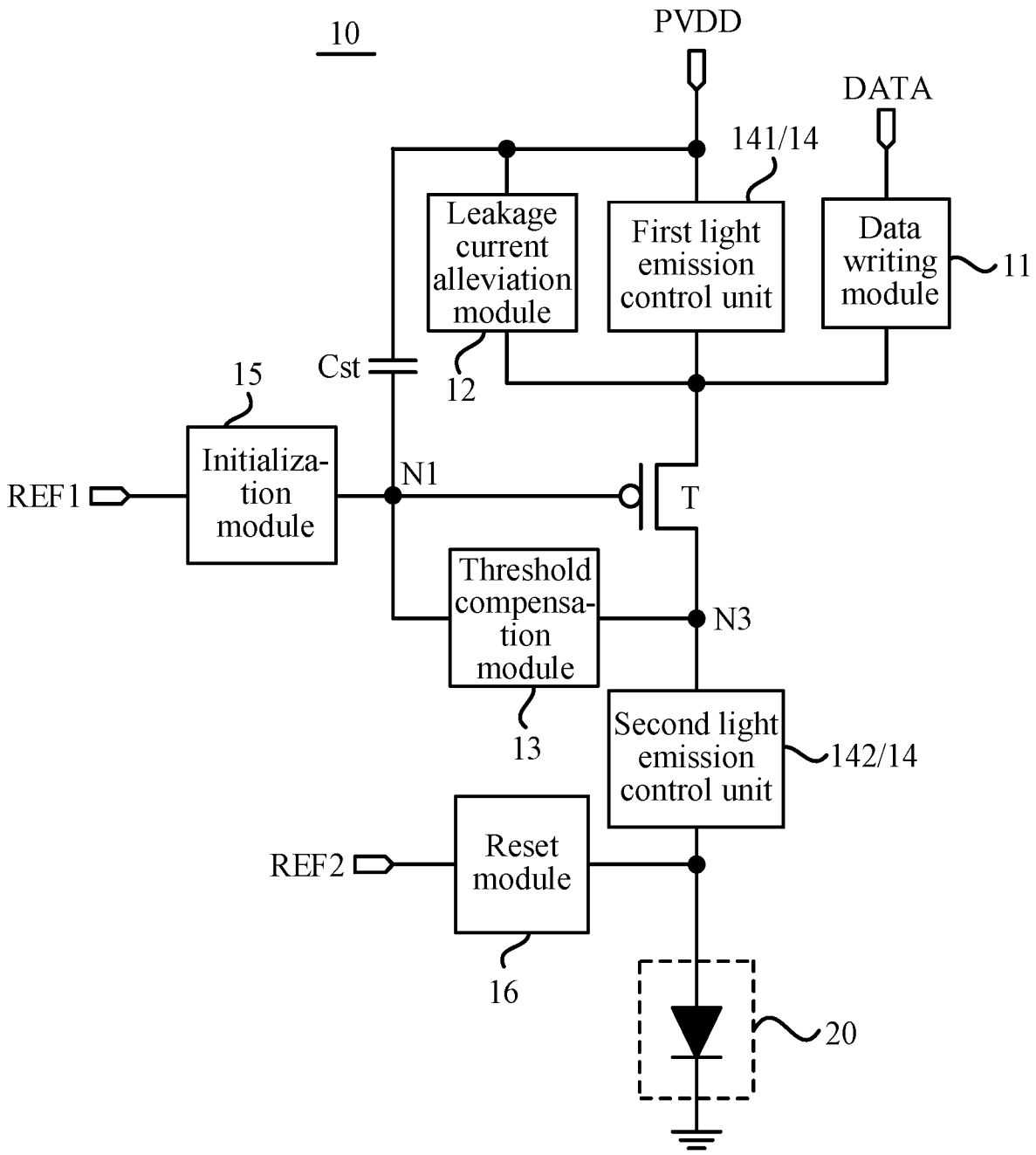
FIG. 19 is another schematic diagram of a pixel circuit according to embodiments of the present disclosure.

In some embodiments, FIG. 19 is another schematic diagram of a pixel circuit according to embodiments of the present disclosure. As shown in FIG. 19, the pixel circuit 10 further includes a reset module 16 and a reset signal terminal REF2; the reset module 16 is electrically connected to the reset signal terminal REF2 and the light-emitting element 20; and the reset module 16 is configured to control a reset signal Vref2 of the reset signal terminal REF2 to be transmitted to the light-emitting element 20 in a reset stage so as to reset the light-emitting element 20 and prevent the light emission stage of the previous drive cycle from affecting the luminance in the light emission stage of the current drive cycle. Among which, the reset stage may be any time segment disposed before the light emission stage; for example, the reset stage may overlap the initialization stage or the data writing stage.

Figure 20:
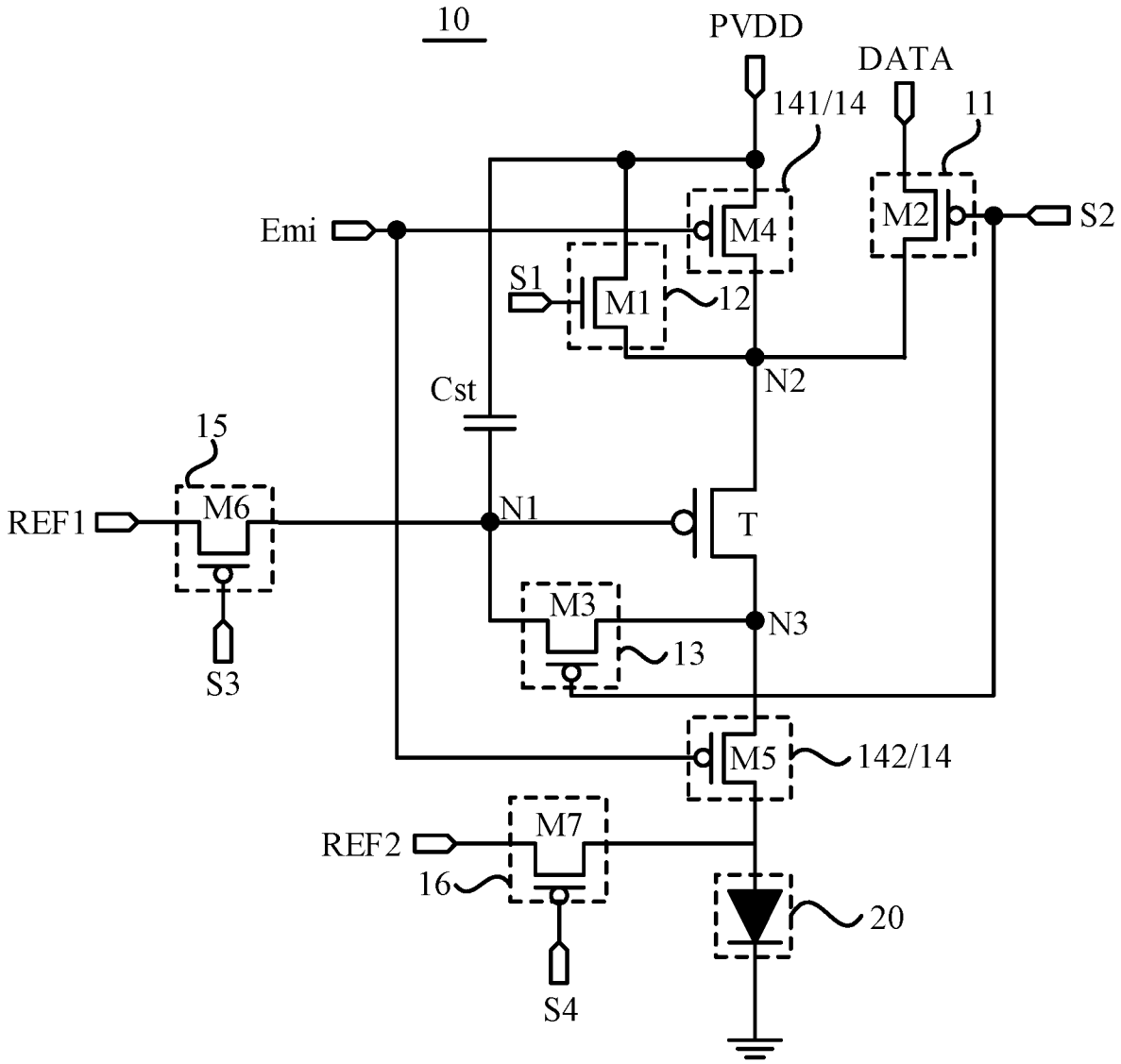
FIG. 20 is another schematic circuit diagram of a pixel circuit according to embodiments of the present disclosure.

As an example, FIG. 20 is another schematic circuit diagram of a pixel circuit according to embodiments of the present disclosure. As shown in FIG. 20, the reset module 16 may include a reset transistor M7. In this case, the pixel circuit 10 may further include a fourth control terminal S4; a first pole of the reset transistor M7 is electrically connected to the reset signal terminal REF2; a second pole of the reset transistor M7 is electrically connected to an anode of the light-emitting element 20; and a gate of the reset transistor M7 is electrically connected to the fourth control terminal S4. With this arrangement, a fourth control signal of the fourth control terminal S4 can control the reset transistor M7 to be turned on or off; and when being turned on, the reset transistor M7 can transmit the reset signal Vref2 of the reset signal terminal REF2 to the anode of the light-emitting element 20 to reset the anode of the light-emitting element 20. Among which, the reset transistor M7 may be an N-type transistor or a P-type transistor, which is not specifically limited in embodiments of the present disclosure. When the channel type of the reset transistor M7 is the same as the channel type of the data writing transistor M2 and the reset stage overlaps the data writing stage, the second control terminal S2 may also serve as the fourth control terminal S4 so that the second control signal of the second control terminal S2 can control the data writing transistor M2 and the reset transistor M7 to be turned on or off simultaneously. In other embodiments, when the channel type of the reset transistor M7 is the same as the channel type of the initialization transistor M6 and the reset stage overlaps the initialization stage, the third control terminal S3 may also serve as the fourth control terminal S4 so that the third control signal of the third control terminal S3 can control the initialization transistor M6 and the reset transistor M7 to be turned on or off simultaneously.

It is to be noted that the reset signal Vref2 of the reset signal terminal REF2 may be same as or different from the initialization signal Vref1 of the initialization signal terminal REF1. This is not specifically limited in embodiments of the present disclosure. When the reset signal Vref2 of the reset signal terminal REF2 is the same as the initialization signal Vref1 of the initialization signal terminal REF1, the initialization signal terminal REF1 may also serve as the reset signal terminal REF2, reducing the number of signal terminals in the pixel circuit 10 and simplifying the structure of the pixel circuit. When the reset signal Vref2 of the reset signal terminal REF2 is different from the initialization signal Vref1 of the initialization signal terminal REF1, the reset signal Vref2 of the reset signal terminal REF2 may be designed based on the reset requirements of the light-emitting element and the initialization signal Vref1 of the initialization signal terminal REF1 may be designed based on the initialization requirements of the gate of the drive transistor.

It is to be understood that to guarantee that the initialization module 15 writes the initialization signal Vref1 of the initialization signal terminal REF1 to the gate of the drive transistor T in the initialization stage, after the gate of the drive transistor T is initialized, the voltage difference between the gate voltage of the drive transistor T and the voltage written to the first pole of the drive transistor T by the data writing module 11 in the data writing stage satisfies a turned-on condition of the drive transistor T. The initialization signal Vref1 of the initialization signal terminal REF1 is usually a negative value.

Similarly, the light-emitting element 20 may be equivalent to a capacitor and a diode; the capacitor of the light-emitting element 20 needs to be charged to the operating voltage so that the light-emitting element 20 emits light; and the reset module 16 writes the reset signal Vref2 of the reset signal terminal REF2 to the light-emitting element 20 in the reset stage with an aim of erasing charges stored in the capacitor of the light-emitting element 20 in the previous drive cycle and thus, preventing the charges stored in the capacitor of the light-emitting element 20 in the previous drive cycle from affecting the luminance of the light-emitting element 20 in the next drive cycle. Accordingly, to guarantee that the charges stored in the capacitor of the light-emitting element 20 are erased completely, the reset signal Vref2 of the reset signal terminal REF2 is usually a negative value.

In some embodiments, with continued reference to FIG. 19, when the reset signal Vref2 of the reset signal terminal REF2 is different from the initialization signal Vref1 of the initialization signal terminal REF1, a voltage of the reset signal Vref2 is lower than a voltage of the initialization signal Vref1.

In some embodiments, since a voltage of the data signal Vdata is usually a positive value, the arrangement in which the initialization signal Vref1 is set to a relatively large voltage guarantees the rapid writing of the data signal and thus, the high-frequency driving of the pixel circuit under the premise that the voltage difference between the gate voltage of the drive transistor T and the voltage at the first pole of the drive transistor T satisfies a turned-on condition of the drive transistor T in the data writing stage. Among which, the driving frequency of the high-frequency driving may be, for example, a driving frequency larger than or equal to 120 Hz. Moreover, the arrangement in which the reset signal Vref2 is set to a relatively small voltage facilitates that the charges stored in the capacitor of the light-emitting element 20 are erased completely, preventing the light-emitting element 20 from causing the phenomenon of the pixel to be turned on abnormally, and thus, improving display effect.

Figure 21:
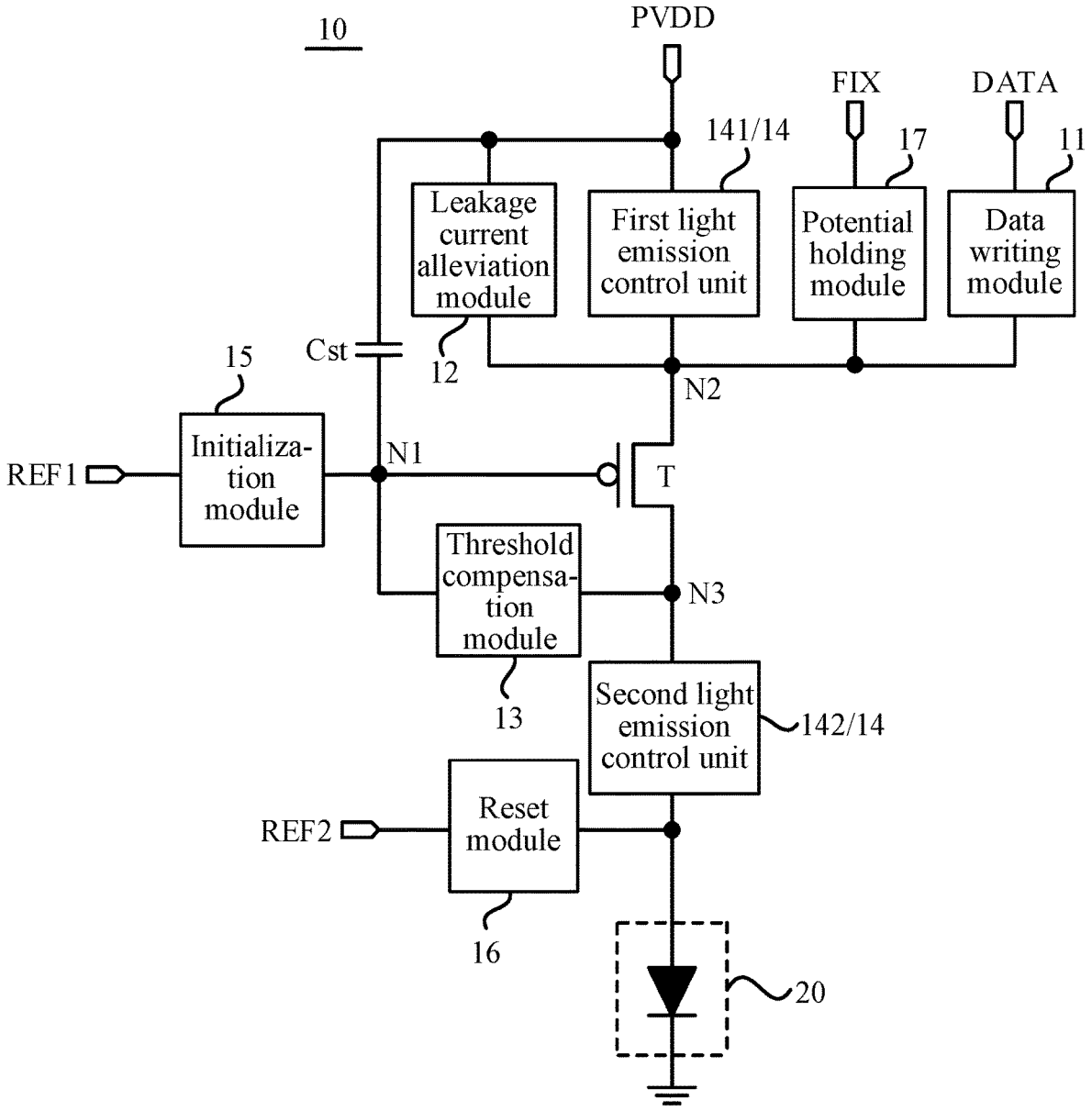
FIG. 21 is another schematic diagram of a pixel circuit according to embodiments of the present disclosure.

Based on preceding embodiments, FIG. 21 is another schematic diagram of a pixel circuit according to embodiments of the present disclosure. As shown in FIG. 21, the pixel circuit may further include a first fixed voltage signal terminal FIX and a potential holding module 17. In this case, the data writing module 11 is electrically connected to the data signal terminal DATA and the first pole of the drive transistor T; the potential holding module 17 is electrically connected to the first fixed voltage signal terminal FIX and the first pole of the drive transistor T; and the potential holding module 17 is configured to control a potential of the first pole of the drive transistor T to be held as a first fixed voltage signal Vf of the first fixed voltage signal terminal FIX in the initialization stage.

In some embodiments, the data writing module 11 is electrically connected to the first pole of the drive transistor T so that in the data writing stage, the data writing module 11 needs to transmit the data signal Vdata of the data signal terminal DATA to the first pole of the drive transistor T first and then through the first pole of the drive transistor T to the gate of the drive transistor T. Moreover, after the voltage at the first pole of the drive transistor T reaches the voltage of the data signal Vdata, it guarantees that the gate voltage of the drive transistor T reaches the voltage of the data signal Vdata. That is, the first pole of the drive transistor T needs to be charged first so that the gate of the drive transistor T can be charged. Accordingly, when the voltage at the first pole of the drive transistor T is relatively low, the first pole of the drive transistor T needs to be charged for a relatively long time so as to reach the voltage of the data signal Vdata, which is unfavorable for the high-frequency driving mode of the pixel circuit.

Moreover, to limit that the size of the pixel circuit and the distances between element structures, connection nodes and connection lines in the pixel circuit are relatively small, certain coupling capacitors are formed between element structures, connection nodes and connection lines in the pixel circuit so that when the voltage of one of the element structures, connection nodes and connection lines jumps, voltages of other element structures, connection nodes and connection lines also jump. For example, when the pixel circuit 10 includes the initialization module 15 and the initialization signal terminal REF1, the initialization module 15 writes the initialization signal Vref1 to the gate of the drive transistor T in the initialization stage so that the gate voltage of the drive transistor turns from the voltage of the data signal Vdata in the previous drive cycle to the voltage of the initialization signal REF1, turning the gate voltage of the drive transistor T from a positive value to a negative voltage. Accordingly, the voltage at the first pole of the drive transistor also jumps, with the first pole of the drive transistor and the gate of the drive transistor T forming a coupling capacitor; that is, the voltage at the first pole of the drive transistor T turns to a relatively small value, unfavorable for the writing of the data signal Vdata whose voltage is a positive value. In some embodiments, when the display panel turns from a black image to a white image, because the gate voltage of the drive transistor in the pixel circuit is a relatively high positive value while the initialization signal Vref1 is a negative value in the black image, the gate voltage of the drive transistor T jumps greatly and the voltage at the first pole of the drive transistor also changes greatly, resulting in that the voltage at the first pole of the drive transistor T fails to be charged to the voltage of the data signal Vdata of the data signal terminal DATA in the data writing stage of the white image and thus, resulting in that the gate voltage of the drive transistor T fails to be charged to the voltage of the data signal Vdata. Accordingly, when the black image is switched to the white image, the luminance of the first frame of the white image is relatively low, and multiple display image frames are needed before the expected luminance of the white image is reached, which needs a relative long time, that is, a relatively long response time.

Figure 22:
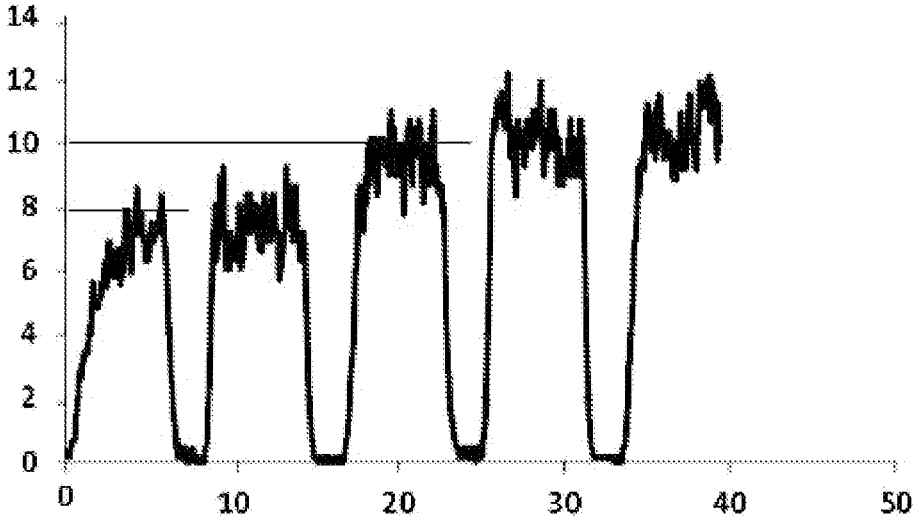
FIG. 22 is a graph of response time against luminance in a display panel in the related art.

As an example, FIG. 22 is a graph of response time against luminance in a display panel in the related art. As shown in FIG. 22, for the display panel in the related art, multiple display image frames are required before a black image is switched to a white image with the expected luminance; and the response time is about 3.5 ms.

With continued reference to FIG. 21, in embodiments of the present disclosure, the potential holding module 17 disposed in the pixel circuit controls the potential of the first pole of the drive transistor T to be held as the first fixed voltage signal Vf of the first fixed voltage signal terminal FIX in the initialization stage before the data writing stage so as to initialize the first pole of the drive transistor T. In such a way, when the data writing module 11 writes the data signal Vdata of the data signal terminal DATA to the first pole of the drive transistor T in the data writing stage, the writing of the data signal Vdata can be performed on the basis of the first fixed voltage signal Vf, preventing a jump of the gate of the drive transistor T from causing a jump of the first pole of the drive transistor T. It takes a relative short time for the voltage at the first pole of the drive transistor T to reach the voltage of the data signal Vdata so that the data signal Vdata can be written to the gate of the drive transistor T rapidly, guaranteeing the accuracy of the charge amount of the gate of the drive transistor T. Thus, in the light emission stage, the drive transistor T can drive the light-emitting element 20 to emit light accurately. Moreover, since the data signal Vdata written by the gate of the drive transistor T is relatively accurate, the expected luminance of the white image can be reached rapidly when a black image is switched to a white image, shortening response time.

Figure 23:
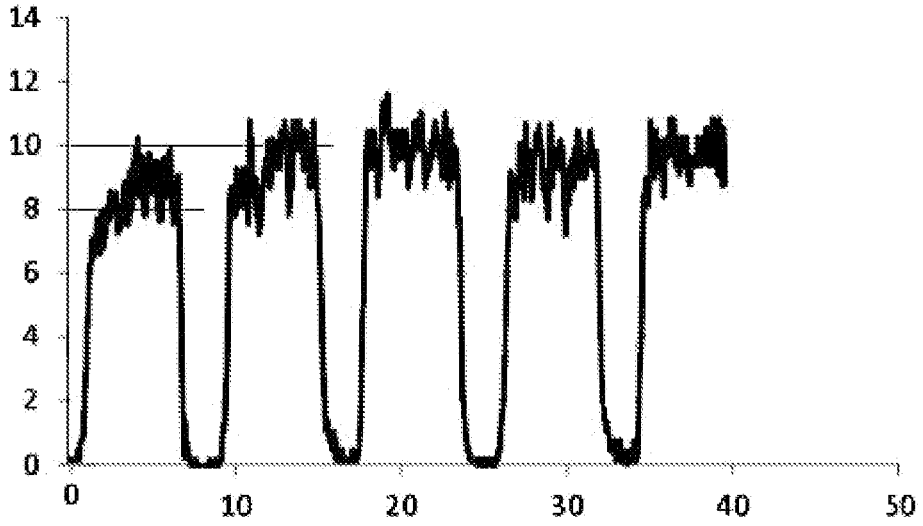
FIG. 23 is a graph of response time against luminance in a display panel according to embodiments of the present disclosure.

As an example, FIG. 23 is a graph of response time against luminance in a display panel according to embodiments of the present disclosure. As shown in FIG. 23, when the pixel circuit provided in embodiments of the present disclosure is applied in a display panel, the display panel can rapidly switch a black image to a white image or pre-display image with the expected luminance, with response time shorter than or equal to 1.5 ms.

Figure 24:
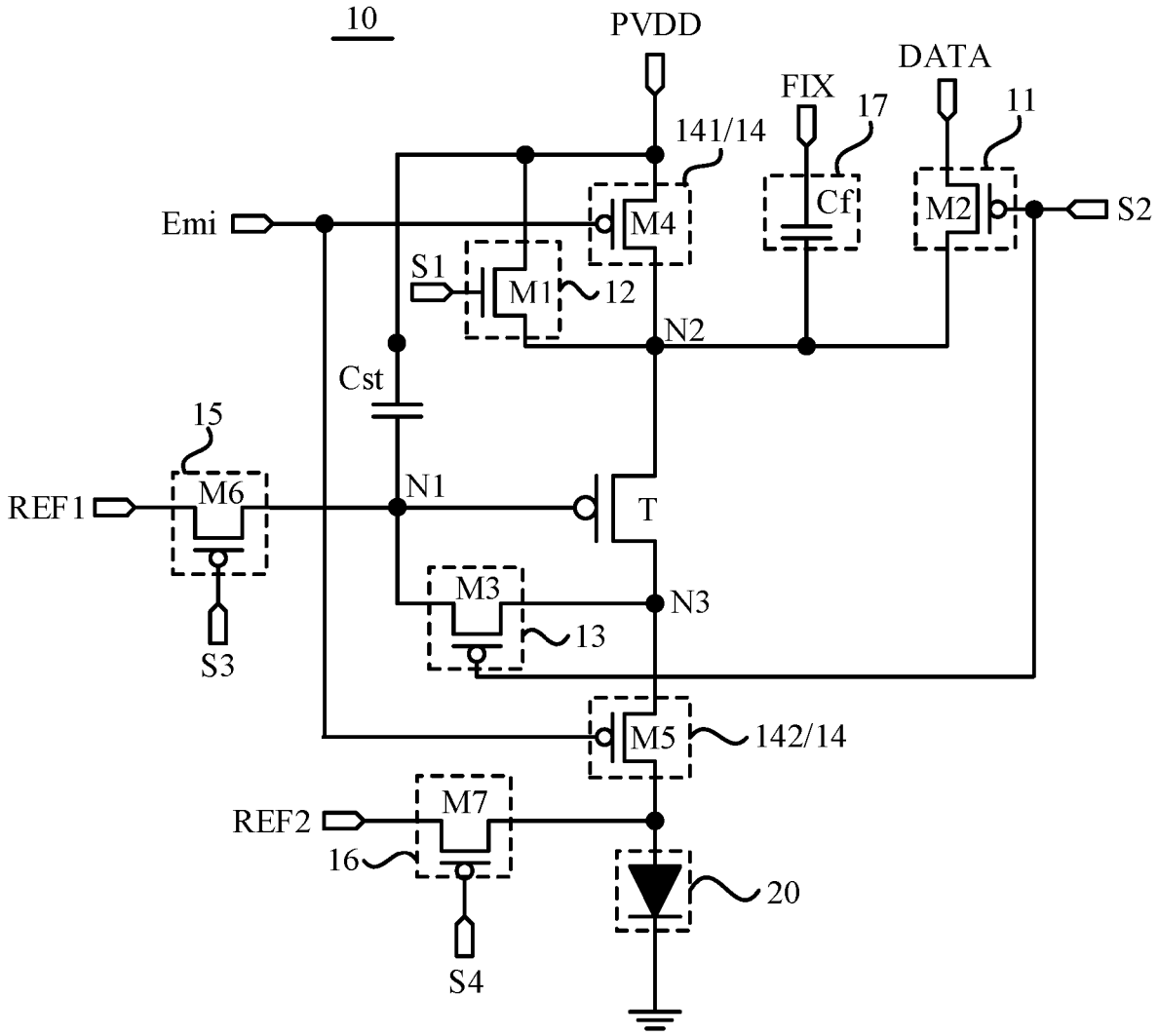
FIG. 24 is another schematic circuit diagram of a pixel circuit according to embodiments of the present disclosure.

In some embodiments, FIG. 24 is another schematic circuit diagram of a pixel circuit according to embodiments of the present disclosure. As shown in FIG. 24, the potential holding module 17 includes a first capacitor Cf; a first plate of the first capacitor Cf is electrically connected to the first fixed voltage signal terminal FIX; and a second plate of the first capacitor Cf is electrically connected to the first pole of the drive transistor T.

With this arrangement, in the initialization stage, the first fixed voltage signal Vf of the first fixed voltage signal terminal FIX received by the first plate of the first capacitor Cf is coupled to the second plate of the first capacitor Cf so that the voltage at the first pole of the drive transistor T electrically connected to the second plate of the first capacitor Cf serves as a voltage of the first fixed voltage signal Vf, implementing the initialization for the first pole of the drive transistor T. In the data writing stage, the first plate of the first capacitor Cf is held as the first fixed voltage signal Vf, and the second plate of the first capacitor Cf is the data signal Vdata written by the data writing module 11, ensuring the rapid and accurate writing of the data signal V data.

Figure 25:
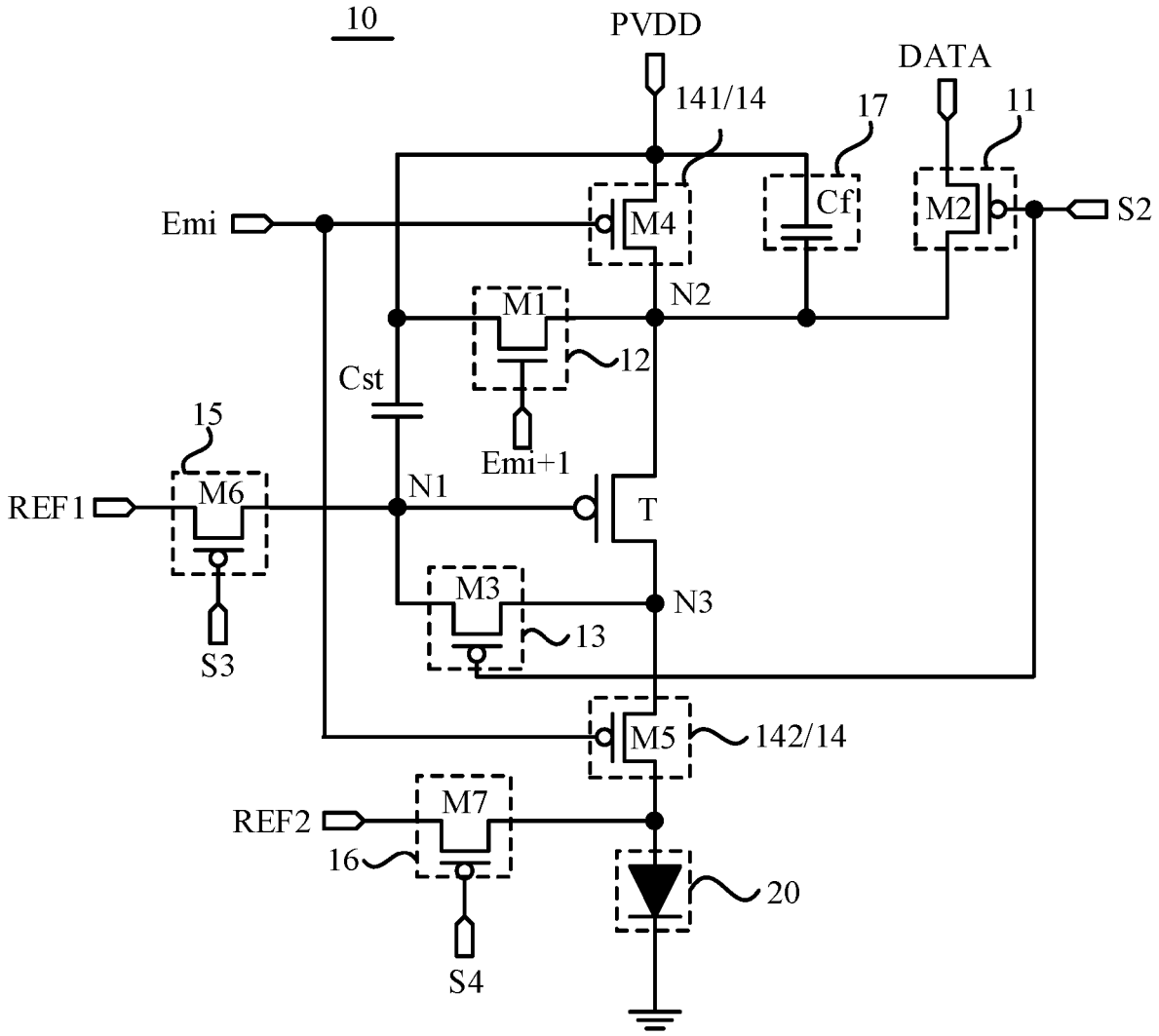
FIG. 25 is another schematic circuit diagram of a pixel circuit according to embodiments of the present disclosure.
Figure 26:
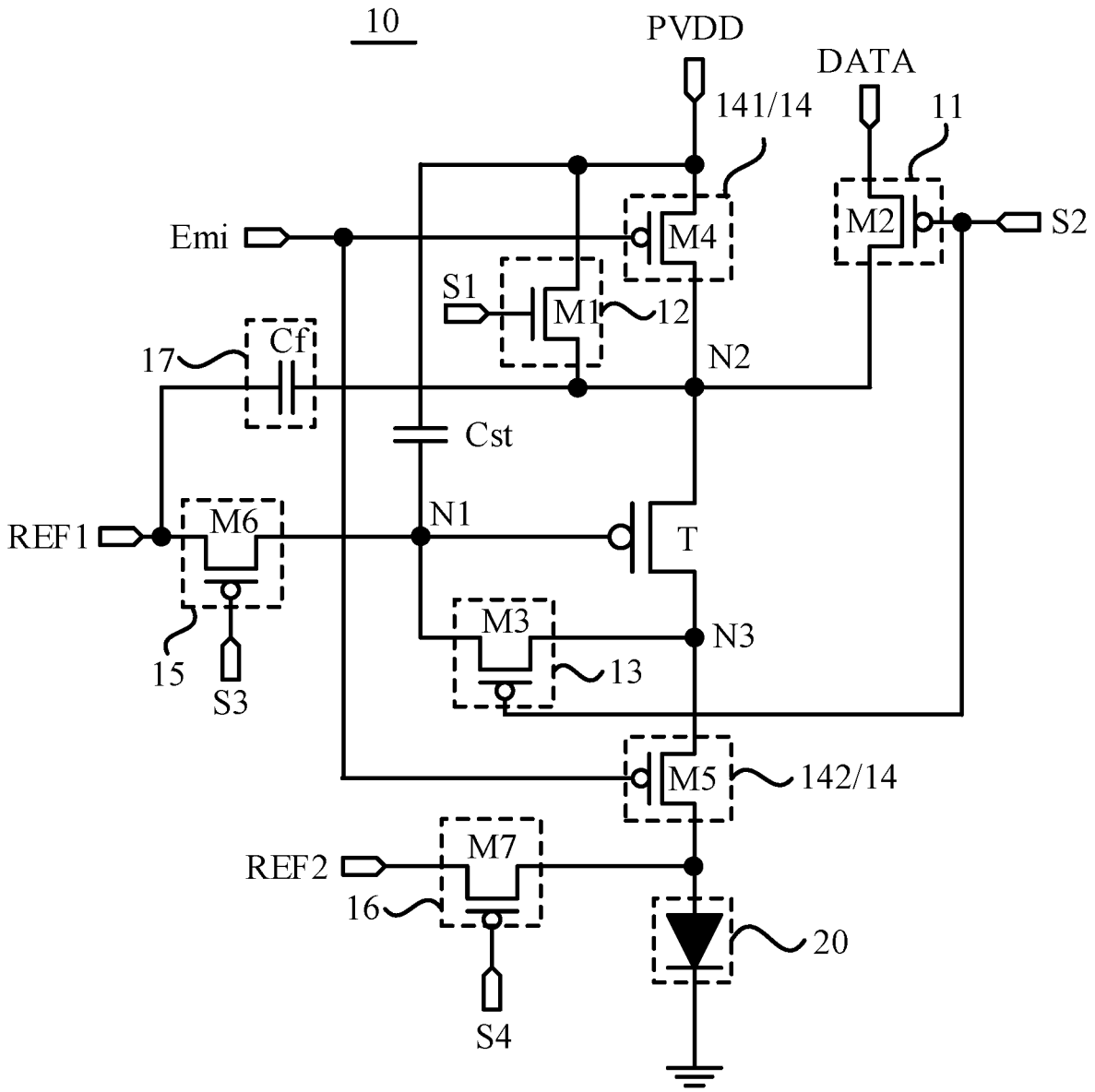
FIG. 26 is another schematic circuit diagram of a pixel circuit according to embodiments of the present disclosure.

It is to be understood that as long as the first fixed voltage signal keeps constant, the rapid and accurate writing of the data signal is guaranteed. With this arrangement, an existing fixed signal terminal in the pixel circuit may also serve as the first fixed voltage signal terminal, reducing the number of signal terminals in the pixel circuit, simplifying the structure of the pixel circuit, reducing the number of signals supplied to the pixel circuit, and reducing the cost of the pixel circuit. As an example, as shown in FIG. 25, the first power supply terminal PVDD may also serve as the first fixed voltage signal terminal. In other embodiments, as shown in FIG. 26, the initialization signal terminal REF1 may also serve as the first fixed voltage signal terminal. For ease of description, unless otherwise specified, an example in which the initialization terminal may also serve as the first fixed voltage signal terminal is taken in embodiments of the present disclosure for exemplarily describing technical solutions in embodiments of the present disclosure.

Figure 27:
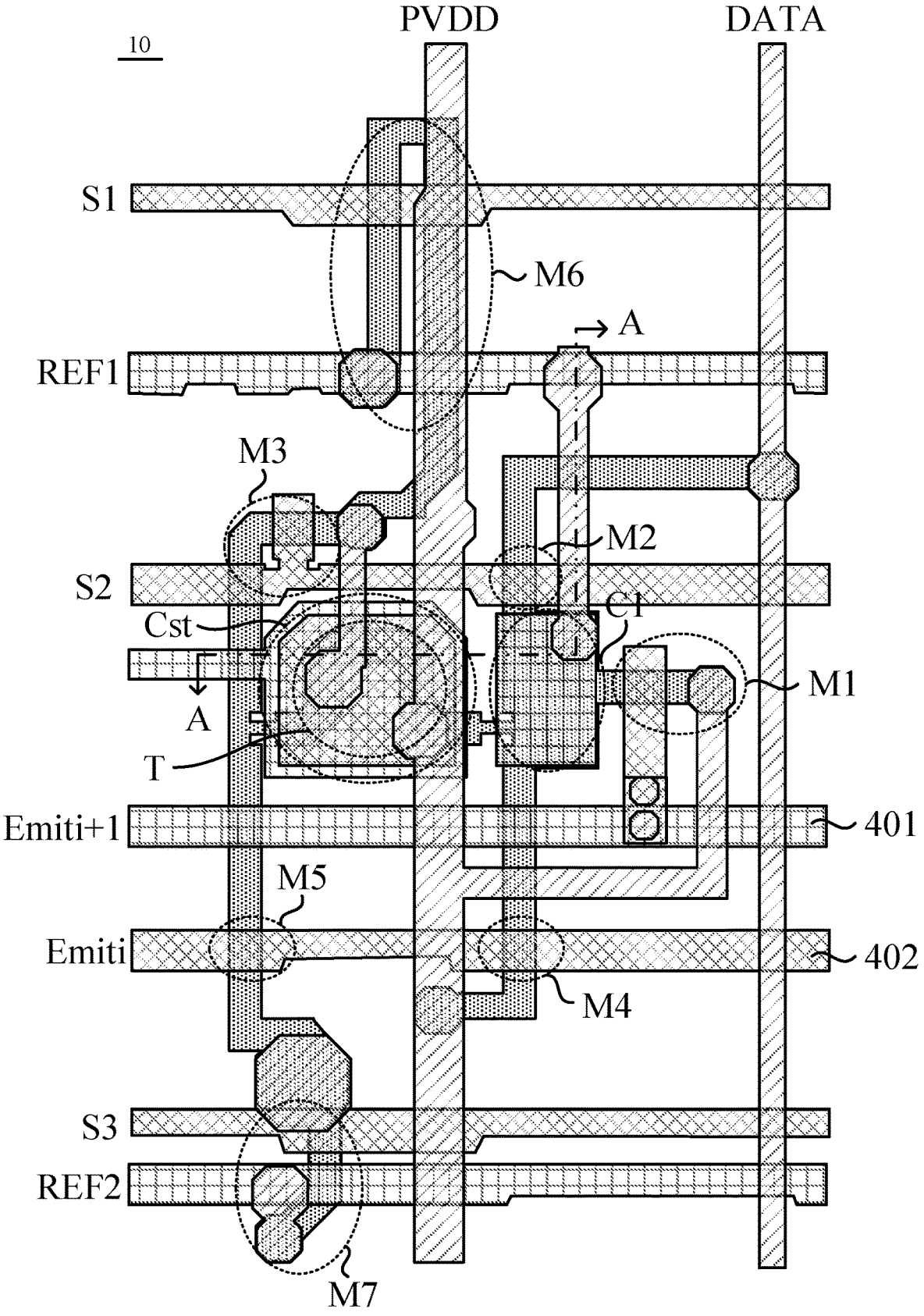
FIG. 27 is another top view of a pixel circuit according to embodiments of the present disclosure.
Figure 28:
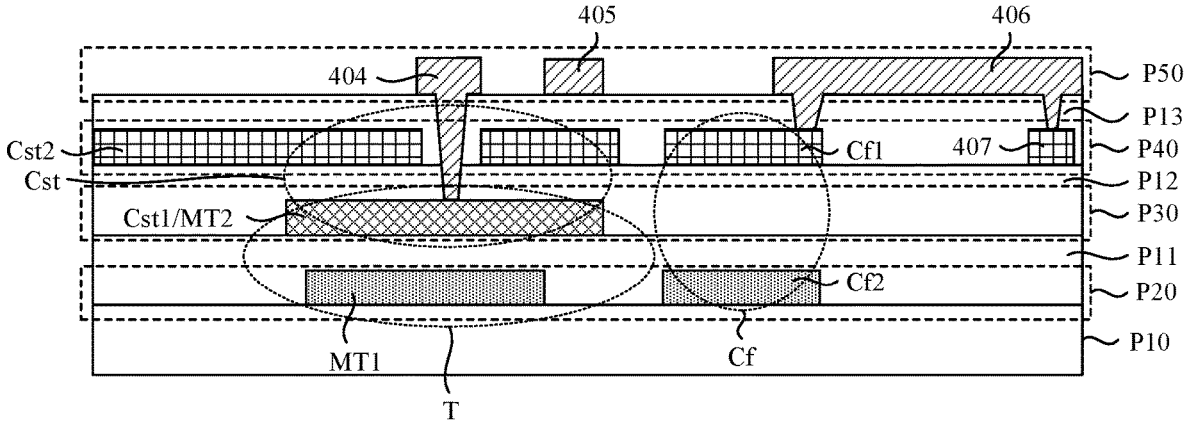
FIG. 28 is a section view taken along section A-A of the pixel circuit of FIG. 27.

In some embodiments, FIG. 27 is a top view of another pixel circuit according to embodiments of the present disclosure, and FIG. 28 is a section view taken along section A-A of the pixel circuit of FIG. 27. With combined reference to FIGS. 27 and 28, when the potential holding module 17 includes the first capacitor Cf, the pixel circuit may include the base substrate P10, and the semiconductor layer P20 and the second metal layer P40 that are disposed on a side of the base substrate P10 and are insulated and spaced apart from each other; the semiconductor layer P20 includes the second plate Cf2 of the first capacitor Cf; and the first metal layer P40 includes the first plate Cf1 of the first capacitor Cf.

Correspondingly, the semiconductor layer P20 further includes the active layer MT1 of the drive transistor T; that is, the active layer MT1 of the drive transistor T and the second plate Cf2 of the first capacitor Cf are disposed in the same layer so that the active layer MT1 of the drive transistor T and the second plate Cf2 of the first capacitor Cf may be formed using the same material in the same process, simplifying the process for manufacturing the pixel circuit 10. Moreover, when the active layer MT1 of the drive transistor T and the second plate Cf2 of the first capacitor Cf are disposed in the same layer, the active layer MT1 of the drive transistor T and the second plate Cf2 of the first capacitor Cf may be an integrated structure with no need of a related joint structure to implement the electrical connection between the first pole of the drive transistor T and the second plate Cf2 of the first capacitor Cf, simplifying the structure of the pixel circuit 10 and reducing the cost of the pixel circuit 10.

In some embodiments, with continued reference to FIGS. 27 and 28, the pixel circuit 10 further includes the first metal layer P30 disposed on a side of the base substrate P10 and insulated and spaced apart from the semiconductor layer P20 and the second metal layer P40. Moreover, the pixel circuit 10 further includes the storage capacitor Cst; the second plate of the storage capacitor Cst is electrically connected to the first power supply terminal PVDD; and the first plate of the storage capacitor Cst is electrically connected to the gate of the drive transistor T. In this case, the first metal layer P30 may include the gate of the drive transistor T and the first plate of the storage capacitor Cst, and the first plate Cst1 of the storage capacitor Cst may also serve as the gate of the drive transistor T. The second metal layer P40 may further include the second plate Cst2 of the storage capacitor Cst; that is, the second plate Cst2 of the storage capacitor Cst and the first plate Cf1 of the first capacitor Cf are disposed in the same layer so that the second plate Cst2 of the storage capacitor Cst and the first plate Cf1 of the first capacitor Cf may be formed using the same material in the same process, simplifying the process for manufacturing the pixel circuit 10.

Additionally, the pixel circuit 10 may further include the third metal layer P50 and the insulating layers (P11, P12, and P13) respectively disposed between the semiconductor layer P20 and the first metal layer P30, between the first metal layer P30 and the second metal layer P40, and between the second metal layer P40 and the third metal layer P50. The third metal layer P50 may include related connection lines joint structures. The connection lines in the third metal layer P50 may include a connection line 405 for electrically connecting the first power supply terminal PVDD; in this case, the second plate Cst2 of the storage capacitor Cst needs to be electrically connected to the connection line 405 through a via hole. The joint structures of the third metal layer P50 may include a joint structure 404 for electrically connecting the gate MT1 of the drive transistor T and a joint structure 406 for electrically connecting the first plate Cf1 of the first capacitor Cf to the initialization signal terminal REF1; in this case, the first plate Cf1 of the first capacitor Cf needs to be electrically connected to the joint structure 406 through a via hole, and then the joint structure 406 is electrically connected to the connection line 407 disposed in the second metal layer P40 through a via hole and then connected to the initialization signal terminal REF1 through the connection line 407, implementing the electrical connection between the first plate Cf1 of the first capacitor Cf and the initialization signal terminal REF1.

Figure 29:
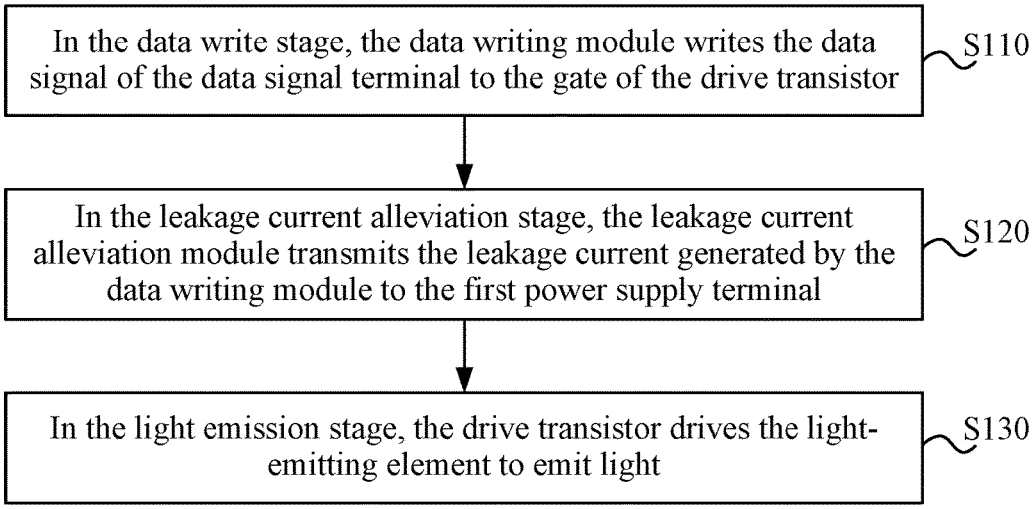
FIG. 29 is a flowchart of a method for driving a pixel circuit according to embodiments of the present disclosure.

Embodiments of the present disclosure further provide a method for driving a pixel circuit. The method is used for driving the pixel circuit provided in embodiments of the present disclosure. The pixel circuit provided in embodiments of the present disclosure may be applied in a display panel. FIG. 29 is a flowchart of a method for driving a pixel circuit according to embodiments of the present disclosure. As shown in FIG. 29, the method for driving a pixel circuit includes the steps below.

In S110, in the data writing stage, the data writing module writes the data signal of the data signal terminal to the gate of the drive transistor.

In S120, in the leakage current alleviation stage, the leakage current alleviation module transmits the leakage current generated by the data writing module to the first power supply terminal.

In S130, in the light emission stage, the drive transistor drives the light-emitting element to emit light.

Among which, the leakage current alleviation stage is located at least between the data writing stage and the light emission stage. With this arrangement, in the leakage current alleviation stage between the data writing stage and the light emission stage, the leakage current alleviation module transmits the leakage current generated by the data writing module to the first power supply terminal, preventing the leakage current generated by the data writing module from affecting the luminance when the drive transistor drives the light-emitting element to emit light. Thus, the light-emitting element can emit light accurately. In such a way, when the pixel circuit is applied in a display panel, the display uniformity of the display panel is enhanced, and thus, the display effect of the display panel is improved. Moreover, the leakage current alleviation module configured in the pixel circuit may prevent the leakage current leaked to the light-emitting element in a non-light-emission stage from causing the light-emitting element to emit weak light, that is, causing the phenomenon of the pixel to be turned on abnormally.

In some embodiments, as shown in FIG. 4, the pixel circuit 10 further includes the first control terminal S1; the leakage current alleviation module 12 may include the first transistor M1; the gate M12 of the first transistor M1 is electrically connected to the first control terminal S1; the first pole of the first transistor M1 is electrically connected to the first power supply terminal PVDD; and the second pole of the first transistor M1 is electrically connected to the data writing module 11. In this case, in the leakage current alleviation stage, the first control signal Scan1 of the first control terminal S1 controls the first transistor M1 to be turned on, and the leakage current generated by the data writing module is transmitted to the first power supply terminal PVDD through the first transistor M1, to prevent the leakage current generated by the data writing module 11 from affecting the luminance of the light-emitting element 20.

In some embodiments, with combined reference to FIGS. 4 and 7, the leakage current alleviation stage t2 may overlap the light emission stage t3. In this case, when the display panel includes pixel circuits 10 in an array and the starting time of light emission stages of each row of pixel circuits 10 are shifted sequentially, enable levels for first light emission control signals Emit i received by each of first light emission control terminals Emi are shifted sequentially, and enable levels for first control signals Scant received by each of first control terminals S1 are shifted sequentially; that is, a first control terminal S1 may also serve as a first light emission control terminal of a pixel circuit in a next row. It is to be noted that an enable level signal described here is not a level signal controlling the first transistor M1 to be turned on but a level signal controlling the first transistor M1 to be turned off, which may specifically refer to the preceding description of a pixel circuit in embodiments of the present disclosure and is not repeated herein.

In some embodiments, with continued reference to FIGS. 4 and 7, when the leakage current alleviation stage overlaps the light emission stage, the overlapping period between the leakage current alleviation stage and the light emission stage is longer than or equal to the duration of the data writing stage. With this arrangement, it ensures that at least after the data writing stage of pixel circuits 10 in the next row ends, the first control signal Scan1 may turn to an enable-level signal, guaranteeing that each pixel circuit 10 in the display panel can emit light accurately.

Figure 30:
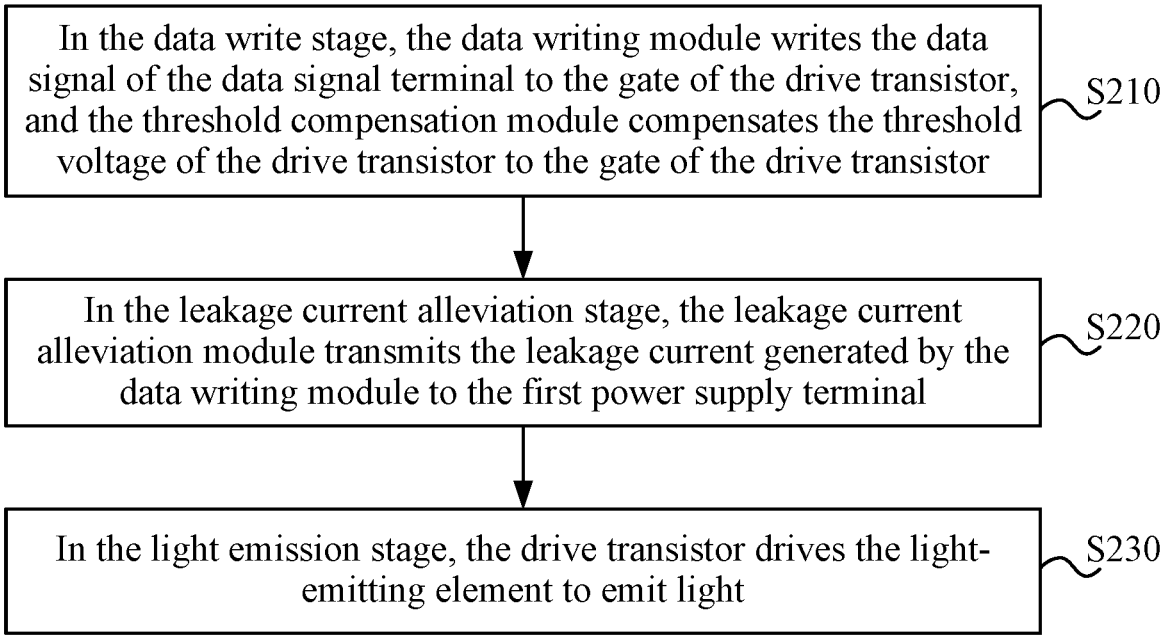
FIG. 30 is another flowchart of a method for driving a pixel circuit according to embodiments of the present disclosure.

In some embodiments, with continued reference to FIG. 1, the pixel circuit 10 further includes the threshold compensation module 13; the first terminal of the data writing module 11 is electrically connected to the data signal terminal DATA; the second terminal of the data writing module 11 is electrically connected to the first pole of the drive transistor T; the second pole of the drive transistor T is electrically connected to the first terminal of the threshold compensation module 13; and the second terminal of the threshold compensation module 13 is electrically connected to the gate of the drive transistor T. In such a way, FIG. 30 is another flowchart of a method for driving a pixel circuit according to embodiments of the present disclosure. As shown in FIG. 30, the method for driving a pixel circuit includes the steps below.

In S210, in the data writing stage, the data writing module writes the data signal of the data signal terminal to the gate of the drive transistor, and the threshold compensation module compensates the threshold voltage of the drive transistor to the gate of the drive transistor.

In S220, in the leakage current alleviation stage, the leakage current alleviation module transmits the leakage current generated by the data writing module to the first power supply terminal.

In S230, in the light emission stage, the drive transistor drives the light-emitting element to emit light.

With this arrangement, in the data writing stage, the data writing module, the drive transistor, and the threshold compensation module may be controlled to stay in the ON state simultaneously so that the data signal of the data signal terminal is transmitted to the gate of the drive transistor sequentially through the turned-on Data writing module, the turned-on drive transistor, and the turned-on threshold compensation module, causing the gate voltage of the drive transistor to change continually. When the voltage difference between the gate voltage of the drive transistor T and the voltage at the first pole of the drive transistor T is equal to the threshold voltage of the drive transistor, the drive transistor T is in the critical stage of turning off. That is, when the data writing stage ends, the gate voltage of the drive transistor is a sum of the data signal written by the data writing module and the threshold voltage compensated by the threshold compensation module. Accordingly, in the light emission stage, the drive current provided by the drive transistor is irrelevant to the threshold voltage of the drive transistor so that processes and element aging are prevented from causing the threshold voltage of the drive transistor to drift and the drive current generated by the drive transistor is prevented from being affected. Thus, the luminance accuracy of the light-emitting element is enhanced. In such a way, when the pixel circuit is applied in a display panel, the display uniformity of the display panel is enhanced.

In some embodiments, as shown in FIG. 14, the pixel circuit 10 further includes the first control terminal S1; the leakage current alleviation module 12 includes the first transistor M1; the first pole of the first transistor M1 is electrically connected to the first power supply terminal PVDD; the second pole of the first transistor M1 is electrically connected to the first terminal of the threshold compensation module 13; and the gate M12 of the first transistor M1 is electrically connected to the first control terminal S1. In such a way, in the leakage current alleviation stage, the first control signal of the first control terminal S1 controls the first transistor M1 to be turned on, and the leakage current leaked by the data signal terminal DATA to the first terminal of the threshold compensation module 13 is transmitted to the first power supply terminal PVDD through the turned-on first transistor M1. With this arrangement, in the leakage current alleviation stage, the first transistor M1 may be in the low-resistance state so that when transmitted to the first terminal of the threshold compensation module 13, the leakage current generated by the data writing module 11 can be transmitted to the first power supply terminal PVDD through the first transistor M1 in the low-resistance state. In such a way, under the premise of guaranteeing the accuracy of the gate voltage of the drive transistor T, the phenomenon of the pixel to be turned on abnormally is avoided.

In some embodiments, when the second pole of the first transistor of the leakage current alleviation module is electrically connected to the first terminal of the threshold compensation module, the leakage current alleviation stage and the light emission stage does not overlap each other so as to prevent a signal transmitted by the leakage current alleviation module from affecting the luminance effect of the light-emitting element in the light emission stage.

Figure 31:
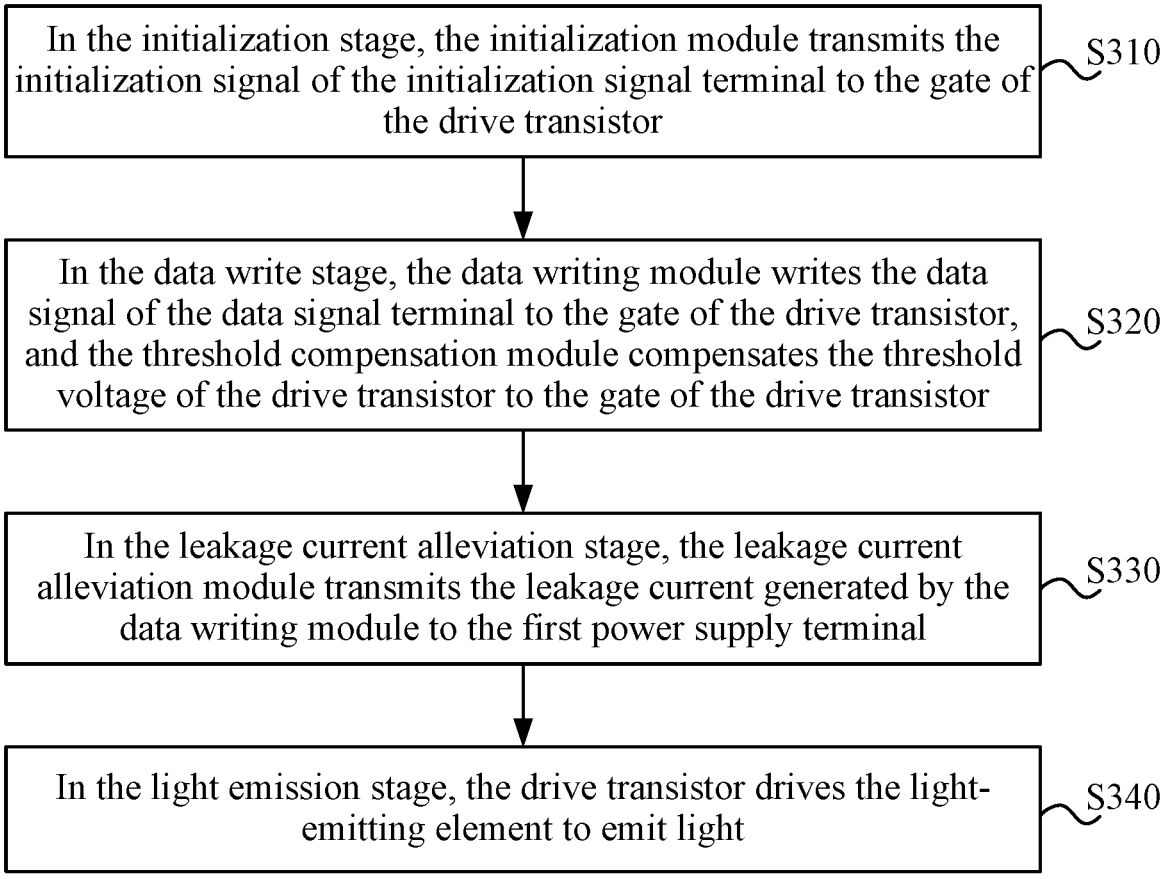
FIG. 31 is another flowchart of a method for driving a pixel circuit according to embodiments of the present disclosure.

In some embodiments, as shown in FIG. 16, the pixel circuit 10 may further include the initialization module 15 and the initialization signal terminal REF1, and the initialization module 15 is electrically connected to the initialization signal terminal REF1 and the gate of the drive transistor T. Correspondingly, FIG. 31 is another flowchart of a method for driving a pixel circuit according to embodiments of the present disclosure. As shown in FIG. 31, the method for driving a pixel circuit includes the steps below.

In S310, in the initialization stage, the initialization module transmits the initialization signal of the initialization signal terminal to the gate of the drive transistor.

In S320, in the data writing stage, the data writing module writes the data signal of the data signal terminal to the gate of the drive transistor, and the threshold compensation module compensates the threshold voltage of the drive transistor to the gate of the drive transistor.

In S330, in the leakage current alleviation stage, the leakage current alleviation module transmits the leakage current generated by the data writing module to the first power supply terminal.

In S340, in the light emission stage, the drive transistor drives the light-emitting element to emit light.

With this arrangement, before the data writing stage, the initialization module initializes the gate of the drive transistor to erase a gate potential of the drive transistor in the previous drive cycle, to ensure that the drive transistor T remains on in the data writing stage of the current drive cycle, and to facilitate the data writing of the data signal of the data signal terminal.

Figure 32:
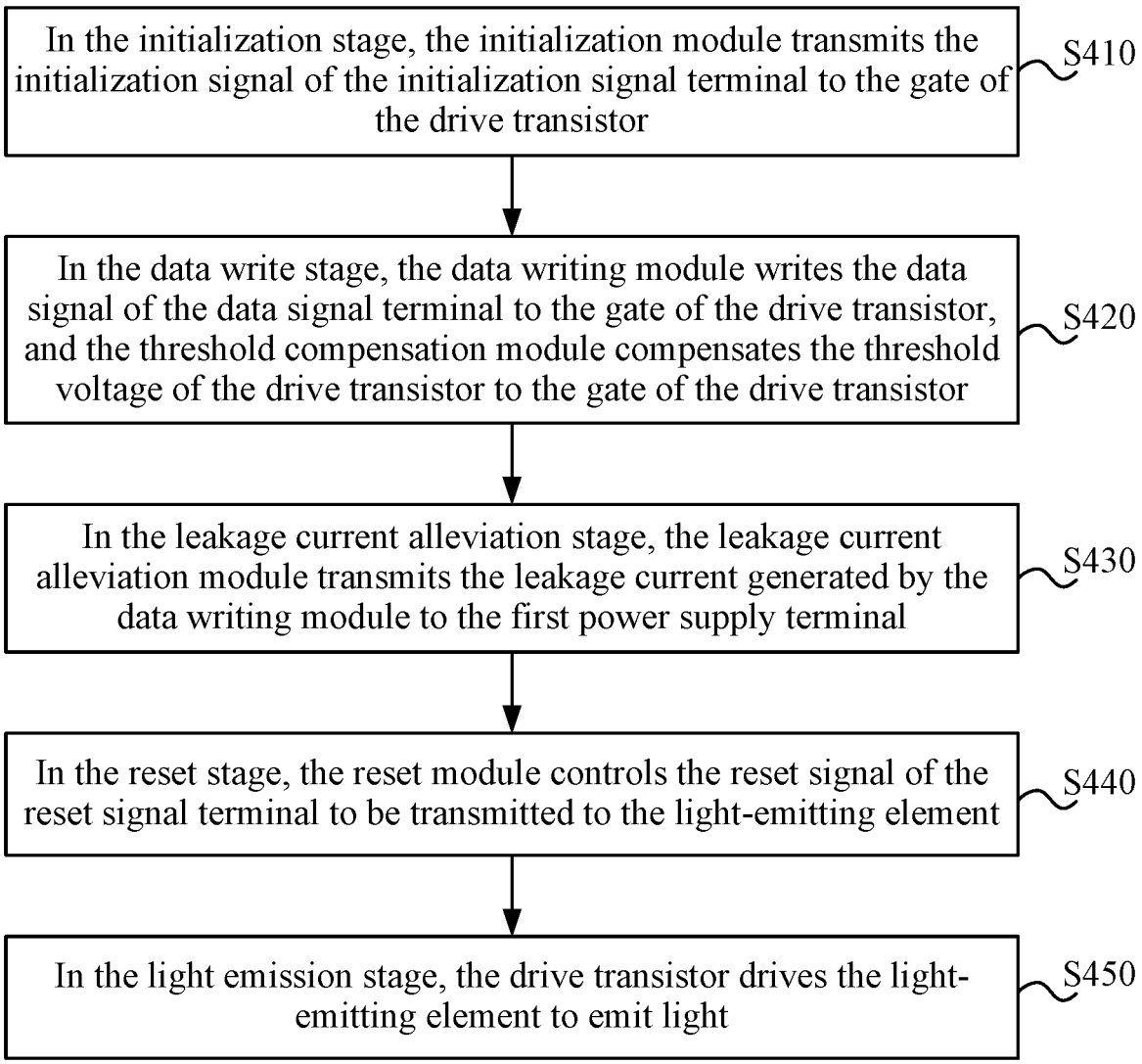
FIG. 32 is another flowchart of a method for driving a pixel circuit according to embodiments of the present disclosure.

In some embodiments, as shown in FIG. 19, the pixel circuit 10 may further include the reset module 16 and the reset signal terminal REF2, and the reset module 16 is electrically connected to the reset signal terminal REF2 and the light-emitting element 20. Correspondingly, FIG. 32 is another flowchart of a method for driving a pixel circuit according to embodiments of the present disclosure. As shown in FIG. 32, the method for driving a pixel circuit includes the steps below.

In S410, in the initialization stage, the initialization module transmits the initialization signal of the initialization signal terminal to the gate of the drive transistor.

In S420, in the data writing stage, the data writing module writes the data signal of the data signal terminal to the gate of the drive transistor, and the threshold compensation module compensates the threshold voltage of the drive transistor to the gate of the drive transistor.

In S430, in the leakage current alleviation stage, the leakage current alleviation module transmits the leakage current generated by the data writing module to the first power supply terminal.

In S440, in the reset stage, the reset module controls the reset signal of the reset signal terminal to be transmitted to the light-emitting element.

In S450, in the light emission stage, the drive transistor drives the light-emitting element to emit light.

With this arrangement, the reset module is controlled to transmit the reset signal of the reset signal terminal to the light-emitting element in the reset stage so as to reset the light-emitting element and prevent the light emission stage of the previous drive cycle from affecting the luminance in the light emission stage of the current drive cycle.

It is to be noted that FIG. 32 is only a flowchart of embodiments of the present disclosure and exemplarily illustrates that the reset stage is located between the light emission stage and the leakage current alleviation stage. In embodiments of the present disclosure, the reset stage may be any time segment disposed before the light emission stage; for example, the reset stage may overlap the initialization stage or the data writing stage. This is not specifically limited in embodiments of the present disclosure.

In some embodiments, as shown in FIG. 21, the pixel circuit may further include the first fixed voltage signal terminal FIX and the potential holding module 17; the data writing module 11 is electrically connected to the data signal terminal DATA and the first pole of the drive transistor T; and the potential holding module 17 is electrically connected to the first fixed voltage signal terminal FIX and the first pole of the drive transistor T. In this case, before the data writing stage, an initialization stage is included; and the potential holding module 17 controls the potential of the first pole of the drive transistor T to be held as the first fixed voltage signal Vf of the first fixed voltage signal terminal FIX in the initialization stage. With this arrangement, since the potential holding module 17 initializes the first pole of the drive transistor T, it takes relatively short time for the first pole of the drive transistor T to reach the voltage of the data signal Vdata so that the data signal Vdata can be written to the gate of the drive transistor T rapidly, guaranteeing the accuracy of the charge amount of the gate of the drive transistor T. Thus, in the light emission stage, the drive transistor T can drive the light-emitting element 20 to emit light accurately. Moreover, since the data signal Vdata written by the gate of the drive transistor T is relatively accurate, the expected luminance of the white image can be reached rapidly when a black image is switched to a white image, shortening response time.

In some embodiments, as shown in FIG. 22, the potential holding module 17 includes the first capacitor Cf; the first plate of the first capacitor Cf is electrically connected to the first fixed voltage signal terminal FIX; and the second plate of the first capacitor Cf is electrically connected to the first pole of the drive transistor T. In this case, in the initialization stage, the first capacitor Cf couples the first fixed voltage signal Vf of the first fixed voltage signal terminal FIX to the first pole of the drive transistor T so that the potential of the first pole of the drive transistor T is held as the first fixed voltage signal Vf, Thus, implementing the initialization for the first pole of the drive transistor T; and in the data writing stage, the first plate of the first capacitor Cf is held as the first fixed voltage signal Vf, and the second plate of the first capacitor Cf is the data signal Vdata written by the data writing module 11, ensuring the rapid and accurate writing of the data signal Vdata.

In some embodiments, the method for driving a pixel circuit further includes that in the pre-display stage of the display panel, the leakage current alleviation module transmits the leakage current generated by the data writing module to the first power supply terminal. Among which, the pre-display stage includes at least one data writing stage and at least one light emission stage, and the drive current generated by the drive transistor in the at least one light emission stage of the pre-display stage is not supplied to the light-emitting element.

In some embodiments, the pre-display stage of the display panel is the start-up stage of the display panel; and in this period, the display panel may perform the black frame insertion process. In the black frame insertion process in the start-up of the display panel, the leakage current alleviation module of each pixel circuit is controlled to transmit the leakage current generated by the data writing module 11 to the first power supply terminal but not to transmit the leakage current to the light-emitting element through the light emission control module, preventing the light-emitting element from emitting light due to the light emission control module leaking the leakage current generated by the data writing module to the light-emitting element in the black frame insertion process in the start-up of the display panel, and thus, avoiding the phenomenon of a flickering screen in the start-up. That is, the problem of a flickering screen in the start-up is solved by controlling the leakage current alleviation module of each pixel circuit to keep in the ON state in the black frame insertion process in the start-up of the display panel.

Embodiments of the present disclosure further provide a display panel. The display panel includes pixel circuits disposed in an array provided in embodiments of the present disclosure. Accordingly, the display panel has the beneficial effects of the pixel circuit provided in embodiments of the present disclosure, and same portions can be understood with reference to the preceding description and are not described in detail hereinafter.

Embodiments of the present disclosure further provide a display apparatus. The display apparatus includes the display panel provided in embodiments of the present disclosure. Accordingly, the display apparatus also has the beneficial effects of the display panel provided in embodiments of the present disclosure, and same portions can be understood with reference to the preceding description and are not described in detail hereinafter.

Figure 33:
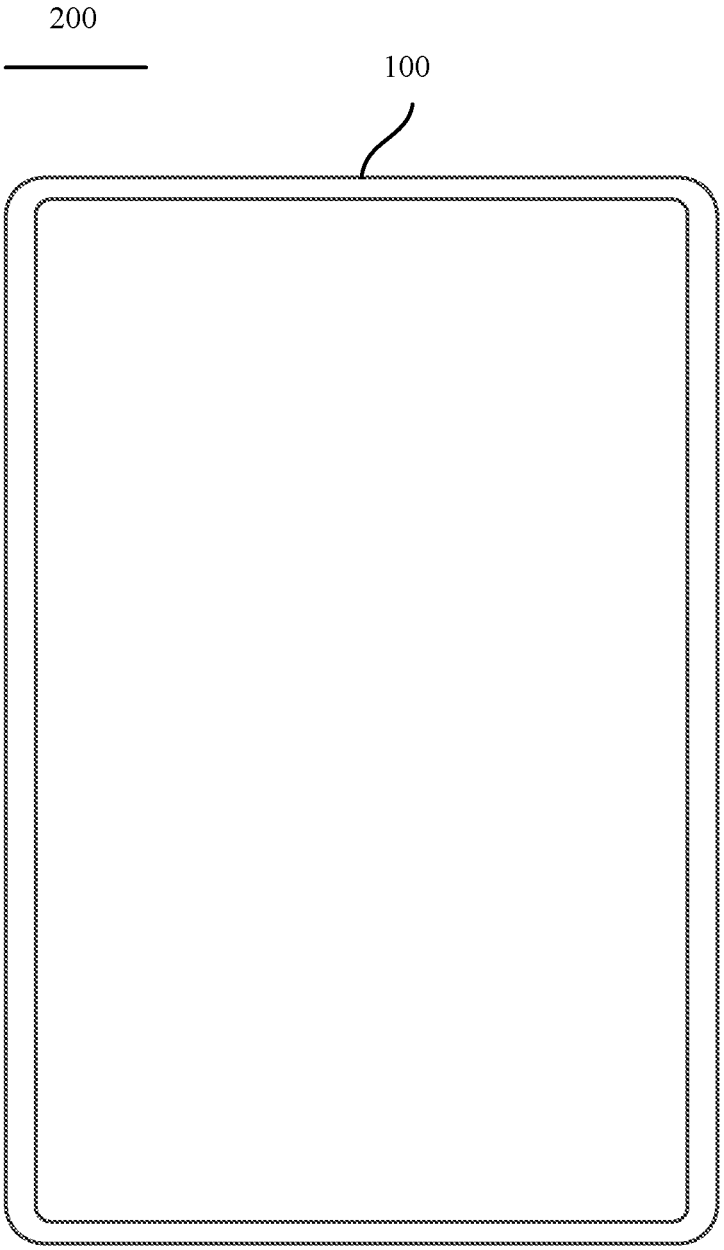
FIG. 33 is a schematic diagram of a display apparatus according to embodiments of the present disclosure.

As an example, FIG. 33 is a schematic diagram of a display apparatus according to embodiments of the present disclosure. As shown in FIG. 33, the display apparatus provided in embodiments of the present disclosure includes the display panel 100 provided in embodiments of the present disclosure. The display apparatus 200 may be any electronic device having a display function, for example, a touch display screen, a mobile phone, a tablet, a laptop, or a television.

It is to be noted that the preceding are only preferred embodiments of the present disclosure and technical principles used therein. It is to be understood by those skilled in the art that the present disclosure is not limited to the embodiments described herein. For those skilled in the art, various apparent modifications, adaptations, combinations, and substitutions can be made without departing from the scope of the present disclosure. Therefore, while the present disclosure has been described in detail via the preceding embodiments, the present disclosure is not limited to the preceding embodiments and may include more equivalent embodiments without departing from the inventive concept of the present disclosure. The scope of the present disclosure is determined by the scope of the appended claims.

What is claimed is:

1. A pixel circuit, comprising a data writing module, a drive transistor, a leakage current alleviation module, a first power supply terminal, and a data signal terminal, wherein the data writing module is configured to write a data signal of the data signal terminal to a gate of the drive transistor in a data writing stage;

the leakage current alleviation module is configured to transmit a leakage current generated by the data writing module to the first power supply terminal in a leakage current alleviation stage; and the drive transistor is configured to drive a light-emitting element to emit light in a light emission stage, wherein the leakage current alleviation stage is located at least between the data writing stage and the light emission stage;

wherein a first terminal of the leakage current alleviation module is electrically connected to the first power supply terminal, a second terminal of the leakage current alleviation module is electrically connected to a second terminal of the data writing module, and a first terminal of the data writing module is electrically connected to the data signal terminal;

the pixel circuit further comprises a first control terminal, the leakage current alleviation module comprises a first transistor, a gate of the first transistor is electrically connected to the first control terminal, a first pole of the first transistor is electrically connected to the first power supply terminal, and a second pole of the first transistor is electrically connected to the second terminal of the data writing module;

the pixel circuit further comprises a light emission control module, the light emission control module is configured to control a drive current generated by the drive transistor to be supplied to the light-emitting element; and the pixel circuit further comprises a first light emission control terminal and a second light emission control terminal, the light emission control module comprises a first light emission control transistor and a second light emission control transistor, a gate of the first light emission control transistor is electrically connected to the first light emission control terminal, a gate of the second light emission control transistor is electrically connected to the second light emission control terminal, a first pole of the first light emission control transistor is electrically connected to the first power supply terminal, a second pole of the first light emission control transistor is electrically connected to a first pole of the drive transistor, a first pole of the second light emission control transistor is electrically connected to a second pole of the drive transistor, and a second pole of the second light emission control transistor is electrically connected to the light-emitting element;

or, wherein the pixel circuit further comprises a threshold compensation module, a first terminal of the data writing module is electrically connected to the data signal terminal, a second terminal of the data writing module is electrically connected to a first pole of the drive transistor, a second pole of the drive transistor is electrically connected to a first terminal of the threshold compensation module, and a second terminal of the threshold compensation module is electrically connected to the gate of the drive transistor;

the threshold compensation module is configured to compensate a threshold voltage of the drive transistor to the gate of the drive transistor in the data writing stage; and a first terminal of the leakage current alleviation module is electrically connected to the first power supply terminal, and a second terminal of the leakage current alleviation module is electrically connected to the first terminal of the threshold compensation module;

or, wherein the leakage current alleviation module is further configured to transmit the leakage current generated by the data writing module to the first power supply terminal in a pre-display stage of the display panel, and the pre-display stage comprises at least one data writing stage and at least one light emission stage, and a drive current generated by the drive transistor in the at least one light emission stage of the pre-display stage is not supplied to the light-emitting element.

2. The pixel circuit according to claim 1, wherein a channel type of the first transistor is different from a channel type of the first light emission control transistor.

3. The pixel circuit according to claim 2, wherein the first light emission control terminal also serves as the second light emission control terminal;

the first light emission control terminal is configured to receive a light emission control signal output from an i-th shift register unit; and the first control terminal is configured to receive a light emission control signal output from an (i+1)-th shift register unit, wherein enable levels for light emission control signals output from each of shift register units are shifted sequentially, and i is a positive integer.

4. The pixel circuit according to claim 2, further comprising:

a base substrate; and a semiconductor layer disposed on a side of the base substrate, wherein the semiconductor layer comprises an active layer of the first transistor, an active layer of the first light emission control transistor, and an active layer of the second light emission control transistor, and wherein the active layer of the first light emission control transistor comprises a first channel region, the active layer of the second light emission control transistor comprises a second channel region, the active layer of the first transistor comprises a third channel region, and a doping type of the first channel region is same as a doping type of the second channel region and different from a doping type of the third channel region.

5. The pixel circuit according to claim 4, further comprising:

a first metal layer disposed on a side of the semiconductor layer facing away from the base substrate, wherein the first metal layer comprises the gate of the first transistor, the gate of the first light emission control transistor, the gate of the second light emission control transistor, and a first connection line; the gate of the first light emission control transistor and the gate of the second light emission control transistor are electrically connected to the first light emission control terminal through the first connection line; and the gate of the first light emission control transistor, the gate of the second light emission control transistor, and the first connection line are an integrated structure; and a second metal layer disposed on a side of the first metal layer facing away from the base substrate, wherein the second metal layer comprises a second connection line, the gate of the first transistor is electrically connected to the second connection line through a via hole and electrically connected to the first control terminal through the second connection line.

6. The pixel circuit according to claim 5, further comprising a storage capacitor, wherein a first plate of the storage capacitor is electrically connected to the gate of the drive transistor, and a second plate of the storage capacitor is electrically connected to the first power supply terminal; and a semiconductor layer further comprises an active layer of the drive transistor, the first metal layer further comprises the first plate of the storage capacitor and the gate of the drive transistor, and the second metal layer comprises the second plate of the storage capacitor.

7. The pixel circuit according to claim 2, further comprising:

a base substrate;

a first semiconductor layer disposed on a side of the base substrate, wherein the first semiconductor layer comprises an active layer of the first light emission control transistor and an active layer of the second light emission control transistor; and a second semiconductor layer disposed on a side of the first semiconductor layer facing away from the base substrate, wherein the second semiconductor layer comprises an active layer of the first transistor.

8. The pixel circuit according to claim 7, further comprising:

a first metal layer disposed on a side of the first semiconductor layer facing away from the base substrate, wherein the first metal layer comprises the gate of the first light emission control transistor and the gate of the second light emission control transistor; and a third metal layer disposed on a side of the second semiconductor layer facing away from the base substrate, wherein the third metal layer comprises the gate of the first transistor.

9. A pixel circuit, comprising a data writing module, a drive transistor, a leakage current alleviation module, a first power supply terminal, and a data signal terminal, wherein the data writing module is configured to write a data signal of the data signal terminal to a gate of the drive transistor in a data writing stage;

the leakage current alleviation module is configured to transmit a leakage current generated by the data writing module to the first power supply terminal in a leakage current alleviation stage;

the drive transistor is configured to drive a light-emitting element to emit light in a light emission stage;

wherein the leakage current alleviation stage is located at least between the data writing stage and the light emission stage;

wherein the pixel circuit further comprises a threshold compensation module, a first terminal of the data writing module is electrically connected to the data signal terminal, a second terminal of the data writing module is electrically connected to a first pole of the drive transistor, a second pole of the drive transistor is electrically connected to a first terminal of the threshold compensation module, and a second terminal of the threshold compensation module is electrically connected to the gate of the drive transistor;

the threshold compensation module is configured to compensate a threshold voltage of the drive transistor to the gate of the drive transistor in the data writing stage; and wherein the pixel circuit further comprises a second control terminal, the threshold compensation module comprises a threshold compensation transistor, a first pole of the threshold compensation transistor is electrically connected to the second pole of the drive transistor, a second pole of the threshold compensation transistor is electrically connected to the gate of the drive transistor, and a gate of the threshold compensation transistor is electrically connected to the second control terminal; and a range of a threshold voltage value Vth' of the threshold compensation transistor satisfies $-0.2V \leq Vth' \leq 0.2V$.

10. The pixel circuit according to claim 1, wherein the leakage current alleviation stage and the light emission stage do not overlap each other.

11. The pixel circuit according to claim 1, further comprising a first control terminal, wherein the leakage current alleviation module comprises a first transistor, a first pole of the first transistor is electrically connected to the first power supply terminal, a second pole of the first transistor is electrically connected to the first terminal of the threshold compensation module, and a gate of the first transistor is electrically connected to the first control terminal.

12. The pixel circuit according to claim 1, further comprising an initialization signal terminal and an initialization module, wherein the initialization module is electrically connected to the initialization signal terminal and the gate of the drive transistor, and the initialization module is configured to transmit an initialization signal of the initialization signal terminal to the gate of the drive transistor in an initialization stage; and the initialization stage is located before the data writing stage.

13. A pixel circuit, comprising a data writing module, a drive transistor, a leakage current alleviation module, a first power supply terminal, and a data signal terminal, wherein the data writing module is configured to write a data signal of the data signal terminal to a gate of the drive transistor in a data writing stage;

the leakage current alleviation module is configured to transmit a leakage current generated by the data writing module to the first power supply terminal in a leakage current alleviation stage;

the drive transistor is configured to drive a light-emitting element to emit light in a light emission stage, wherein the leakage current alleviation stage is located at least between the data writing stage and the light emission stage; and wherein the pixel circuit further comprises a first fixed voltage signal terminal and a potential holding module, the data writing module is electrically connected to the data signal terminal and a first pole of the drive transistor, and the potential holding module is electrically connected to the first fixed voltage signal terminal and the first pole of the drive transistor; and the potential holding module is configured to control a potential of the first pole of the drive transistor to be held as a fixed voltage signal in the initialization stage.

14. The pixel circuit according to claim 13, wherein one of the initialization signal terminal and the first power supply terminal also serves as the first fixed voltage signal terminal.

15. The pixel circuit according to claim 13, wherein the potential holding module comprises a first capacitor, a first plate of the first capacitor is electrically connected to the first fixed voltage signal terminal, and a second plate of the first capacitor is electrically connected to the first pole of the drive transistor.

16. The pixel circuit according to claim 13, wherein in response to a black image of the display panel being switched to a preset display image, time for the light-emitting element reaching a preset luminance is shorter than or equal to 1.5 ms.

17. The pixel circuit according to claim 12, further comprising a reset module and a reset signal terminal, wherein the reset module is electrically connected to the reset signal terminal and the light-emitting element, and the reset module is configured to control a reset signal of the reset signal terminal to be transmitted to the light-emitting element in a reset stage.

18. A pixel circuit, comprising a data writing module, a drive transistor, a leakage current alleviation module, a first power supply terminal, and a data signal terminal, wherein the data writing module is configured to write a data signal of the data signal terminal to a gate of the drive transistor in a data writing stage;

the leakage current alleviation module is configured to transmit a leakage current generated by the data writing module to the first power supply terminal in a leakage current alleviation stage; and the drive transistor is configured to drive a light-emitting element to emit light in a light emission stage, wherein the leakage current alleviation stage is located at least between the data writing stage and the light emission stage; and wherein duration of the leakage current alleviation stage t and duration of the data writing stage t' satisfy $t \geq n \times t'$, and $n \geq 10$.

19. A method for driving a pixel circuit, wherein the pixel circuit comprises a data writing module, a drive transistor, a leakage current alleviation module, a first power supply terminal, and a data signal terminal, wherein the data writing module is configured to write a data signal of the data signal terminal to a gate of the drive transistor in a data writing stage;

the leakage current alleviation module is configured to transmit a leakage current generated by the data writing module to the first power supply terminal in a leakage current alleviation stage; and the drive transistor is configured to drive a light-emitting element to emit light in a light emission stage, wherein the leakage current alleviation stage is located at least between the data writing stage and the light emission stage, and the method comprises:

in the data writing stage, writing, by the data writing module, the data signal of the data signal terminal to the gate of the drive transistor;

in the leakage current alleviation stage, transmitting, by the leakage current alleviation module, the leakage current generated by the data writing module to the first power supply terminal; and in the light emission stage, driving, by the drive transistor, the light-emitting element to emit light;

wherein the leakage current alleviation stage is located at least between the data writing stage and the light emission stage; and wherein the pixel circuit further comprises a first control terminal, the leakage current alleviation module comprises a first transistor, a gate of the first transistor is electrically connected to the first control terminal, a first pole of the first transistor is electrically connected to the first power supply terminal, and a second pole of the first transistor is electrically connected to the data writing module;

in the leakage current alleviation stage, the method comprises:

controlling the first transistor to be turned on through a first control signal of the first control terminal; and transmitting the leakage current generated by the data writing module to the first power supply terminal through the first transistor, or, wherein the pixel circuit further comprises a threshold compensation module, a first terminal of the data writing module is electrically connected to the data signal terminal, a second terminal of the data writing module is electrically connected to a first pole of the drive transistor, a second pole of the drive transistor is electrically connected to a first terminal of the threshold compensation module, and a second terminal of the threshold compensation module is electrically connected to the gate of the drive transistor; and in the data writing stage, the method comprises:

compensating, by the threshold compensation module, a threshold voltage of the drive transistor to the gate of the drive transistor; and the pixel circuit further comprises a first control terminal, the leakage current alleviation module comprises a first transistor, a first pole of the first transistor is electrically connected to the first power supply terminal, a second pole of the first transistor is electrically connected to the first terminal of the threshold compensation module, and a gate of the first transistor is electrically connected to the first control terminal; and in the leakage current alleviation stage, the method comprises:

controlling the first transistor to be turned on through a first control signal of the first control terminal, and transmitting the leakage current leaked by the data signal terminal to the first terminal of the threshold compensation module to the first power supply terminal through the turned-on first transistor;

or, wherein the method further comprises:

in a pre-display stage of the display panel, transmitting, by the leakage current alleviation module, the leakage current generated by the data writing module to the first power supply terminal, and the pre-display stage comprises at least one data writing stage and at least one light emission stage, and in the at least one light emission stage, a drive current generated by the drive transistor of the pre-display stage is not supplied to the light-emitting element.

20. The method for driving a pixel circuit according to claim 19, wherein the leakage current alleviation stage and the light emission stage overlap each other.

21. The method for driving a pixel circuit according to claim 20, wherein an overlapping period between the leakage current alleviation stage and the light emission stage is longer than or equal to a duration of the data writing stage.

22. The method for driving a pixel circuit according to claim 19, wherein the leakage current alleviation stage and the light emission stage do not overlap each other.

23. The method for driving a pixel circuit according to claim 19, wherein the pixel circuit further comprises an initialization module and an initialization signal terminal, and the initialization module is electrically connected to the initialization signal terminal and the gate of the drive transistor; and before the data writing stage, the method comprises:

transmitting, by the initialization module, an initialization signal of the initialization signal terminal to the gate of the drive transistor in an initialization stage.

24. A method for driving a pixel circuit, wherein the pixel circuit comprises a data writing module, a drive transistor, a leakage current alleviation module, a first power supply terminal, and a data signal terminal, wherein the data writing module is configured to write a data signal of the data signal terminal to a gate of the drive transistor in a data writing stage;

the leakage current alleviation module is configured to transmit a leakage current generated by the data writing module to the first power supply terminal in a leakage current alleviation stage; and the drive transistor is configured to drive a light-emitting element to emit light in a light emission stage, wherein the leakage current alleviation stage is located at least between the data writing stage and the light emission stage, and the method comprises:

in the data writing stage, writing, by the data writing module, the data signal of the data signal terminal to the gate of the drive transistor;

in the leakage current alleviation stage, transmitting, by the leakage current alleviation module, the leakage current generated by the data writing module to the first power supply terminal; and in the light emission stage, driving, by the drive transistor, the light-emitting element to emit light;

wherein the leakage current alleviation stage is located at least between the data writing stage and the light emission stage;

wherein the pixel circuit further comprises an initialization module and an initialization signal terminal, and the initialization module is electrically connected to the initialization signal terminal and the gate of the drive transistor; and before the data writing stage, the method comprises:

transmitting, by the initialization module, an initialization signal of the initialization signal terminal to the gate of the drive transistor in an initialization stage; and wherein the pixel circuit further comprises a first fixed voltage signal terminal and a potential holding module, and the potential holding module is electrically connected to the first fixed voltage signal terminal and a first pole of the drive transistor; and in the initialization stage before the data writing stage, the method comprises:

controlling, by the potential holding module, a potential of the first pole of the drive transistor to be held as a fixed voltage signal.

25. The method for driving a pixel circuit according to claim 24, wherein the potential holding module comprises a first capacitor, a first plate of the first capacitor is electrically connected to the first fixed voltage signal terminal, and a second plate of the first capacitor is electrically connected to the first pole of the drive transistor; and the controlling, by the potential holding module, a potential of the first pole of the drive transistor to be held as a first fixed voltage signal of the first fixed voltage signal terminal, comprises:

coupling, by the first capacitor, the first fixed voltage signal of the first fixed voltage signal terminal to the first pole of the drive transistor, to enable the potential of the first pole of the drive transistor to be held as the first fixed voltage signal.

26. A display panel, comprising a plurality of pixel circuits, wherein each of the plurality of pixel circuits comprises the pixel circuit according to claim 1, and wherein the leakage current alleviation stage is located at least between the data writing stage and the light emission stage.

27. A display apparatus, comprising the display panel according to claim 26.

* * * * *